US010001726B2

(12) United States Patent
Kanazawa et al.

(10) Patent No.: US 10,001,726 B2
(45) Date of Patent: Jun. 19, 2018

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventors: Takayuki Kanazawa, Yokohama (JP); Kazuhisa Shida, Kawasaki (JP); Yuta Isobe, Kawasaki (JP); Shunsuke Mizukoshi, Yokohama (JP); Nobuo Oshima, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/415,010

(22) Filed: Jan. 25, 2017

(65) Prior Publication Data

US 2017/0219963 A1 Aug. 3, 2017

(30) Foreign Application Priority Data

Jan. 29, 2016 (JP) ..... 2016-014973

(51) Int. Cl.
*G03G 15/08* (2006.01)

(52) U.S. Cl.
CPC ..... *G03G 15/0898* (2013.01); *G03G 15/0882* (2013.01); *G03G 2215/0687* (2013.01)

(58) Field of Classification Search
USPC ..... 399/91, 98, 102, 103, 106, 109, 111
See application file for complete search history.

(56) References Cited

U.S. PATENT DOCUMENTS

| | | | | |
|---|---|---|---|---|
| 6,763,209 | B2 | 7/2004 | Higeta et al. | |
| 9,069,289 | B2 * | 6/2015 | Batori | G03G 15/0882 |
| 9,207,581 | B2 * | 12/2015 | Wada | G03G 15/0898 |

FOREIGN PATENT DOCUMENTS

| | | | |
|---|---|---|---|
| JP | H0527572 | A | 2/1993 |
| JP | H05197288 | A | 8/1993 |
| JP | H07219328 | A | 8/1995 |
| JP | 2003140531 | A | 5/2003 |
| JP | 2014149519 | A | 8/2014 |
| JP | 2015179177 | A | 10/2015 |

* cited by examiner

*Primary Examiner* — Hoan Tran
(74) *Attorney, Agent, or Firm* — Rossi, Kimms & McDowell LLP

(57) ABSTRACT

Provided is a developer container, including: a frame body having an opening; a sealing member configured to seal the opening; an unsealing member configured to unseal the opening by moving the sealing member and accommodated inside the frame body; and a part of the sealing member peelably bonded to an outer peripheral edge of the opening on an opposite side of the unsealing member with respect to the opening.

18 Claims, 20 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

The present invention relates to a developer container, a developing device, a process cartridge, and an image forming apparatus including any one of the developer container, the developing device, and the process cartridge.

Description of the Related Art

<Cartridge>

An image forming apparatus forms an image on a recording medium using electrophotographic image forming process. For example, the image forming apparatus includes an electrophotographic copying machine and an electrophotographic printer. The image forming apparatus, e.g., a copying machine using an electrophotographic technology, often includes a process cartridge integrally including image forming process units necessary for image formation, such as a photosensitive drum serving as an image bearing member, a developing device, a charging device, and a cleaning device. With this configuration, replacement of the image forming process units due to the end of a life or the like can be facilitated. A developing cartridge obtained by forming only the developing device into a cartridge has also been used.

A developing device in the process cartridge or a developing cartridge has the following configuration. The developing device includes: a developing sleeve serving as a developer carrier arranged close to a photosensitive drum serving as an image bearing member; and a developing chamber having a developing blade configured to regulate a layer thickness of toner being developer to be carried on a surface of the developing sleeve.

The developing device further includes a stirring chamber serving as a storage portion in which the toner to be supplied into the developing chamber is stored.

An opening serving as a toner supply port is formed between the stirring chamber and the developing chamber. After the toner is filled into the stirring chamber of the developer container, the opening is covered with a sealing member, thereby hermetically enclosing the toner in the stirring chamber of the developer container. In this manner, the toner can be prevented from leaking from the developer container before use.

<Automatic Unsealing of Sealing Member>

When the process cartridge is in a new condition, the process cartridge is used after the opening sealed by the sealing member is unsealed. In recent years, in view of usability, there has been adopted a configuration of peeling the sealing member by only mounting the process cartridge into a main body of the image forming apparatus. In Japanese Patent Application Laid-Open No. H05-197288, one end of a toner sealing material is fixed to a rotation shaft of a stirring member inside a developer container, and the toner sealing material is automatically reeled up around the rotation shaft along with drive of a main body of an image forming apparatus.

<Sealing of Opening by Sealing Member During Remanufacture of Process Cartridge>

When the used process cartridge is remanufactured, it is important that toner does not leak from the process cartridge to be remanufactured. In Japanese Patent Application Laid-Open No. H05-027572, a sealing member which can be repeatedly removed and mounted is proposed, and the sealing member can be used during remanufacture. In Japanese Patent Application Laid-Open No. 2003-140531, there is proposed a remanufacturing method capable of achieving reduction of toner leakage by processing a sealed portion during remanufacture even when a sealing member is not used.

When the process cartridge is remanufactured, it is more preferred that there be not used a special member and a special step for enclosing the toner during remanufacture as proposed in Japanese Patent Application Laid-Open No. H05-027572 and Japanese Patent Application Laid-Open No. 2003-140531.

The present invention has been made in order to solve the above-mentioned problems, and has an object to provide a developer container enabling a sealing member to seal an opening from an outer side of the developer container.

SUMMARY OF THE INVENTION

In order to achieve the above-mentioned object, according to one embodiment of the present invention, there is provided a developer container, including: a frame body having an opening; a sealing member configured to seal the opening; an unsealing member configured to unseal the opening by moving the sealing member and accommodated inside the frame body; and a part of the sealing member peelably bonded to an outer peripheral edge of the opening on an opposite side of the unsealing member with respect to the opening.

Further features of the present invention will become apparent from the following description of exemplary embodiments with reference to the attached drawings.

DESCRIPTION OF THE EMBODIMENTS

With reference to the attached drawings, detailed description is made of an image forming apparatus including a developer container, a developing device, and a process cartridge, which are removably mounted, according to embodiments of the present invention. In the following embodiments, examples of a process cartridge B including a developing device 20 with a developer container 29 are described. However, the present invention is not limited thereto, and it is only necessary that the developing device 20 be provided. The developing device 20 may include a developing sleeve 32 serving as a developer carrier, and the developer container 29 formed of frame bodies in which developer is to be stored. Further, it is only necessary that the process cartridge B include at least a photosensitive drum 62 serving as an image bearing member.

First Embodiment

First, with reference to FIG. 1 to FIG. 10C, description is made of an image forming apparatus including a developer container, a developing device, and a process cartridge, which are removably mounted, according to a first embodiment of the present invention.

<Image Forming Apparatus>

Figure 1:
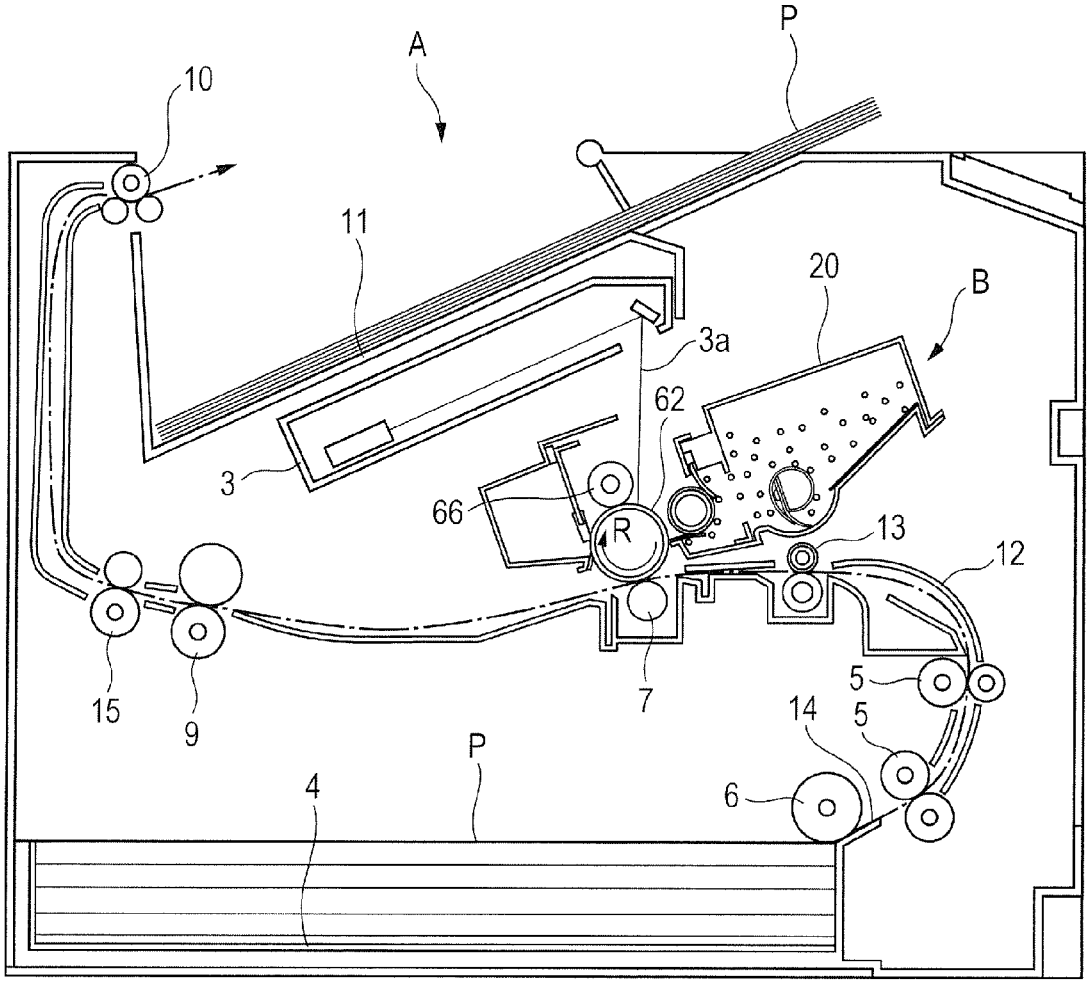
FIG. 1 is an explanatory sectional view for illustrating an image forming apparatus including a developer container, a developing device, and a process cartridge, which are removably mounted, according to a first embodiment of the present invention.
Figure 2:
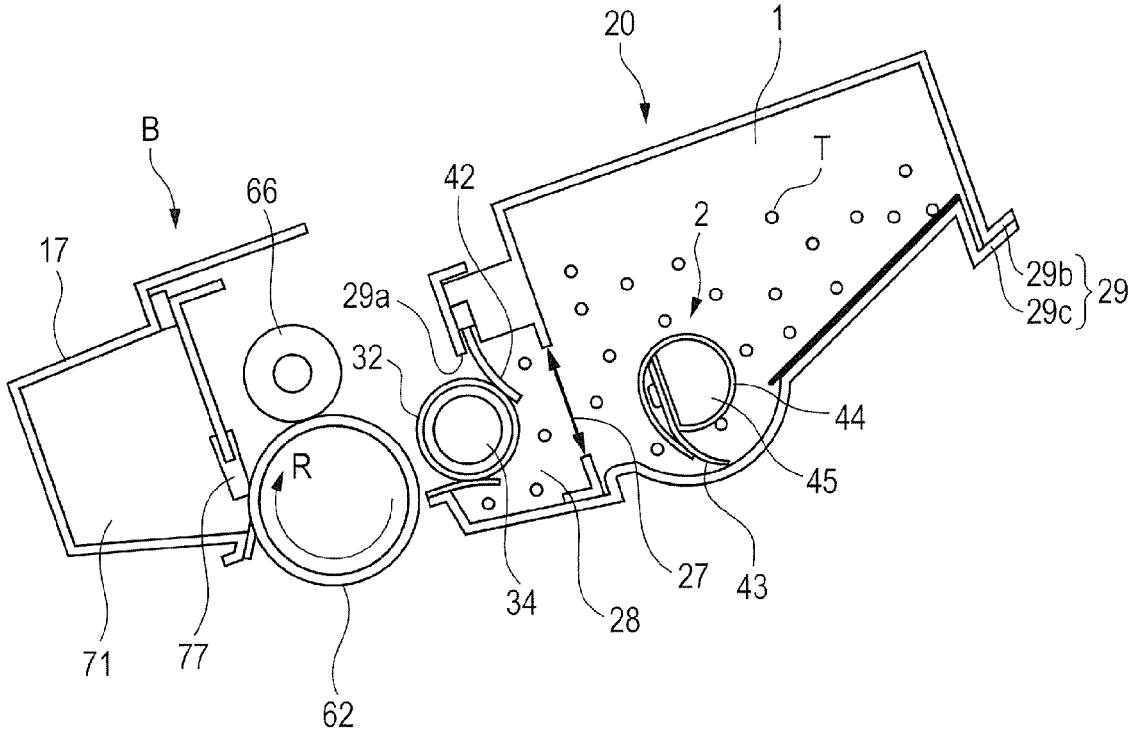
FIG. 2 is an explanatory sectional view for illustrating the developer container, the developing device, and the process cartridge according to the first embodiment.

Description is made of image forming process of an image forming apparatus A, together with an image forming process unit, according to this embodiment illustrated in FIG. 1. In this embodiment, an example of reusing a sealing member 44 is described on the precondition that the used process cartridge B is remanufactured. FIG. 1 is an explanatory sectional view for illustrating an image forming apparatus including a developer container, a developing device, and a process cartridge, which are removably mounted, according to a first embodiment of the present invention. FIG. 2 is an explanatory sectional view for illustrating the developer container, the developing device, and the process cartridge according to the first embodiment.

In FIG. 1, a recording material P, e.g., paper, which is accommodated in a feed cassette 4 arranged in a lower portion of a main body of the image forming apparatus A, is drawn out by a feed roller 6, and then separated and fed by a separating pad 14 one after another. Then, after the recording material P is nipped and conveyed by conveying rollers 5 along a conveying guide 12, a leading edge of the recording material P is brought into abutment against a nip portion of registration rollers 13 that are temporality stopped. Depending on strength of stiffness of the recording material P, skew feed of the recording material P is corrected. Then, the registration rollers 13 are rotated at predetermined timing. The recording material P is nipped and conveyed by the registration rollers 13, and then conveyed to a transfer portion formed of a nip portion between a surface of the photosensitive drum 62, which serves as the image bearing member having an electrostatic latent image formed thereon, and a transfer roller 7, which serves as a transferring unit.

In synchronization with conveyance of the recording material P, a charging roller 66 serving as a charging unit uniformly charges the surface of the photosensitive drum 62 rotated in a direction of the arrow R of FIG. 2. Then, a laser scanner 3 serving as an image exposing unit emits a laser light 3*a* corresponding to image information, and selectively exposes the uniformly charged surface of the photosensitive drum 62, thereby forming the electrostatic latent image. The photosensitive drum 62 and the charging roller 66 are each a rotary member. The photosensitive drum 62 is rotated in the direction of the arrow R of FIG. 2, whereas the charging roller 66 is rotated to follow the photosensitive drum 62. The laser scanner 3 causes a polygon mirror (not shown) to reflect the laser light 3*a* corresponding to image information, thereby exposing the surface of the photosensitive drum 62 in a main scanning direction and a sub-scanning direction.

Toner T, which is magnetic one-component developer stored in a stirring chamber 1 (first chamber) of the developer container 29, is conveyed while being stirred by a stirring member 43. The stirring member 43 is arranged in the stirring chamber 1 in a rotatable manner, and serves as an unsealing member configured to unseal an opening 27. The stirring member 43 also serves as a conveying member configured to convey the toner T being the developer toward the opening 27. With this configuration, the toner T is conveyed into a developing chamber 28 (second chamber) in which the developing sleeve 32 is arranged. The developing sleeve 32 is a developer carrier arranged in a container body 29*b* of the developer container (in the developer container 29) so as to be opposed to the surface of the photosensitive drum 62.

The developing sleeve 32 is a hollow rotary member, and a magnet roller 34 is arranged inside the developing sleeve 32. The toner T is carried and conveyed onto a surface of the developing sleeve 32 due to a magnetic force of the magnet roller 34. In addition, a desired amount of the toner T is carried in a form of a thin layer onto the surface of the developing sleeve 32 by a developing blade 42.

Next, a developing bias is applied from a developing bias source (not shown) to the developing sleeve 32. Thus, the toner T carried onto the surface of the developing sleeve 32 is supplied to the electrostatic latent image formed on the surface of the photosensitive drum 62, to thereby be developed as a toner image (developer image). Next, a transfer bias is applied from a transfer bias source (not shown) to the transfer roller 7 being a rotary member. Thus, the toner image formed on the surface of the photosensitive drum 62 is transferred onto the recording material P conveyed in synchronization with the toner image.

The recording material P having the toner image transferred thereon is conveyed to a fixing device 9 serving as a fixing unit. The recording material P is heated and pressurized in a course of being nipped and conveyed by a fixing roller and a pressure roller arranged in the fixing device 9. Thus, the toner image is thermally melted, to thereby be thermally fixed on the recording material P. In this manner, the image is formed on the recording material P. The recording material P having the toner image fixed thereon is conveyed by conveying rollers 15, and then delivered by delivery rollers 10 onto a delivery portion 11 provided in an upper portion of the image forming apparatus A.

A transfer residual toner remaining on the surface of the photosensitive drum 62 after the transfer is scratched off by a cleaning blade 77 having elasticity and serving as a cleaning unit, and the surface of the photosensitive drum 62 is cleaned. After the cleaning, the toner is stored as a waste toner in a waste toner chamber 71.

<Stirring Unit>

Figure 5A:
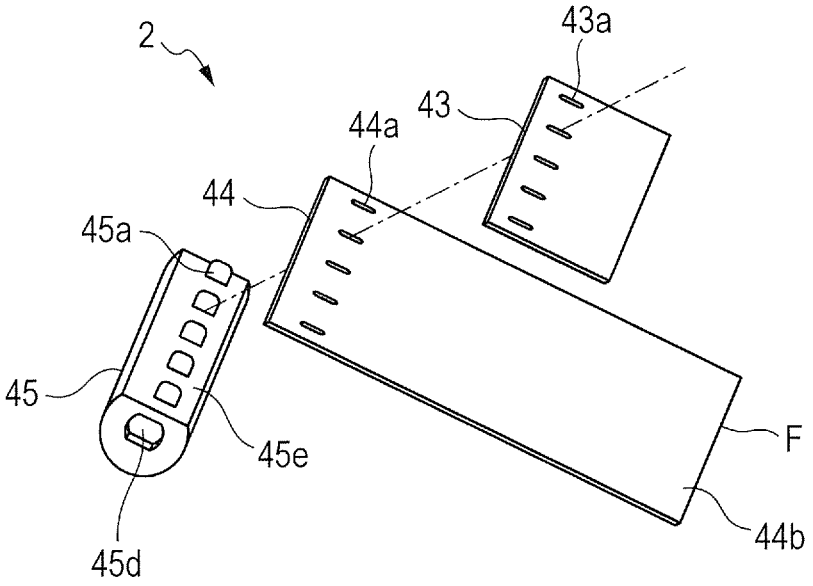
FIG. 5A is an exploded perspective view for illustrating a stirring unit including a rotating member, a sealing member, and a stirring member.
Figure 5B:
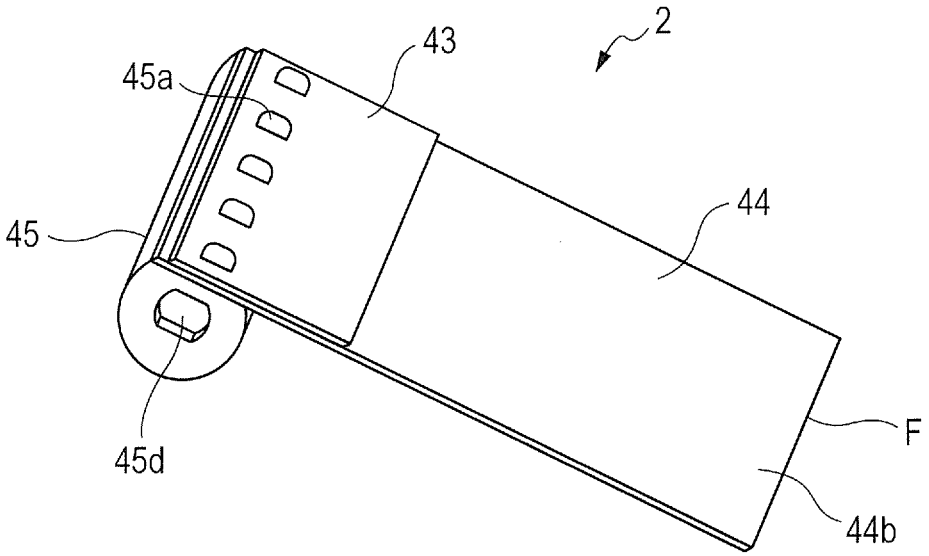
FIG. 5B is an explanatory perspective view for illustrating the stirring unit obtained by assembling the rotating member, the sealing member, and the stirring member together.

Next, with reference to FIG. 5A and FIG. 5B, a stirring unit 2 is described. FIG. 5A is an exploded perspective view for illustrating the stirring unit 2 including a rotating member 45, the sealing member 44, and the stirring member 43. FIG. 5B is an explanatory perspective view for illustrating the stirring unit 2 obtained by assembling the rotating member 45, the sealing member 44, and the stirring member 43 together. As illustrated in FIG. 5A, the stirring unit 2 includes the rotating member 45, the sealing member 44 formed of a flexible sheet-like member, and the sheet-like stirring member 43. The rotating member 45 is configured to drive the stirring member 43 serving as the unsealing member to rotate. The sealing member 44 is configured to seal the opening 27, and is mounted to the rotating member 45.

In this embodiment, the stirring member 43 also serves as the unsealing member. Through use of the stirring member 43 also serving as the unsealing member rather than providing the unsealing member as a separate member, the number of components can be reduced, and cost can be reduced. However, the present invention is not limited thereto. The stirring member and the unsealing member may be formed of separate members. The sealing member 44 is mounted to the unsealing member, and the unsealing member is driven to move by a gear that is a drive transmitting member mounted to the developer container 29. With this configuration, the sealing member 44 is also moved so that a sealing portion 44*b* bonded to an edge of the opening 27 is peeled. Thus, the opening 27 is unsealed.

In this embodiment, the stirring member 43 of the stirring unit 2 serves as the stirring member configured to stir the developer in the developer container 29, the conveying member configured to convey the developer in the developer container 29 toward the opening 27, and the unsealing member configured to unseal the sealing member 44 that seals the opening 27. Alternatively, the stirring member, the conveying member, and the unsealing member may be formed of separate members, or the stirring member 43 may serve as at least two among the stirring member, the conveying member, and the unsealing member.

The sealing member 44 can be made of polyethylene terephthalate (PET) compatible with a material forming the developer container 29. In addition, the sealing member 44 can be made of polycarbonate (PC) or polyphenylene sulfide (PPS).

Those materials can form a flexible sheet-like member. In addition, those materials are melted by heat, and are capable of being bonded to the developer container 29. In one end portion of the sealing member 44 in a long-side direction (direction orthogonal to an axial direction of the rotating member 45), hole portions 44*a* formed of a plurality of through-holes to serve as fixing portions are formed along a short-side direction of the sealing member 44 (along the axial direction of the rotating member 45).

Similarly to the sealing member 44, the stirring member 43 can be made of sheet-like polyethylene terephthalate (PET). In addition, the stirring member 43 can be made of polycarbonate (PC) or polyphenylene sulfide (PPS). Those materials are flexible. In the stirring member 43, hole portions 43*a* formed of a plurality of through-holes serving as fixing portions are formed along a long-side direction of the stirring member 43 (along the axial direction of the rotating member 45).

As illustrated in FIG. 5A, the sealing member 44 and the stirring member 43 are supported in such a manner that the hole portions 44*a* and the hole portions 43*a* are fitted to shaft portions 45*a* protruding from a fixing surface 45*e* of the rotating member 45. After that, the shaft portions 45*a* of the rotating member 45 are thermally caulked. In this manner, the sealing member 44 and the stirring member 43 are fixed to the fixing surface 45*e* of the rotating member 45 as illustrated in FIG. 5B.

In this embodiment, the sealing member 44 and the stirring member 43 are fixed to the fixing surface 45*e* of the rotating member 45 by inserting the shaft portions 45*a*, which protrude from the fixing surface 45*e*, through the hole portions 44*a* of the sealing member 44 and the hole portions 43*a* of the stirring member 43 and then thermally caulking the shaft portions 45*a*. Alternatively, the sealing member 44 and the stirring member 43 may be fixed and locked to the fixing surface 45*e* of the rotating member 45, for example, with a double-sided adhesive tape or through snap-fitting.

<Method of Mounting Stirring Unit>

Figure 6:
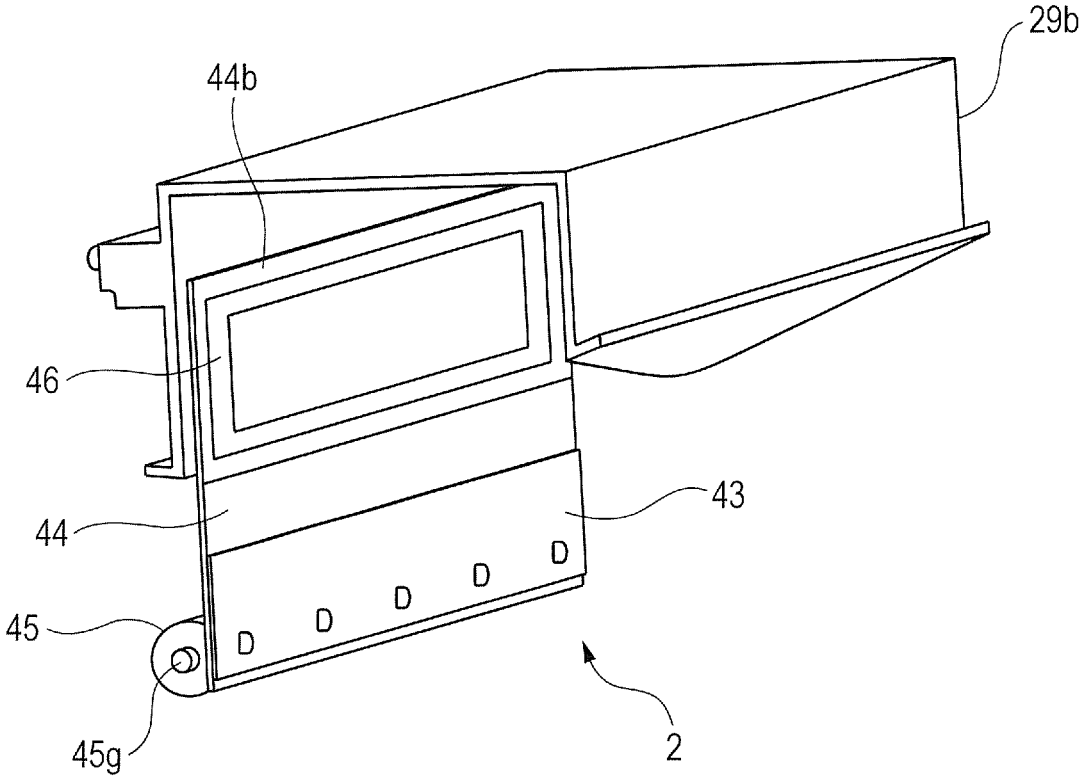
FIG. 6 is an explanatory perspective view for illustrating a state in which a sealing portion of the sealing member is peelably bonded to a peripheral edge portion of an opening formed in the developer container according to the first embodiment.

With reference to FIG. 6, a method of mounting the stirring unit 2 to the developer container 29 is described. As illustrated in FIG. 6, the sealing portion 44*b* on a free end portion F side of the sealing member 44 fixed to the fixing surface 45*e* of the rotating member 45 has the following configuration. The sealing portion 44*b* is peelably fixed to a bonding region 46 by thermal welding or the like. The bonding region 46 is formed over an entire periphery of the opening 27 in a peripheral edge portion on the stirring chamber 1 side (inner side) of the opening 27 formed in the container body 29*b* of the developer container 29.

Figure 3:
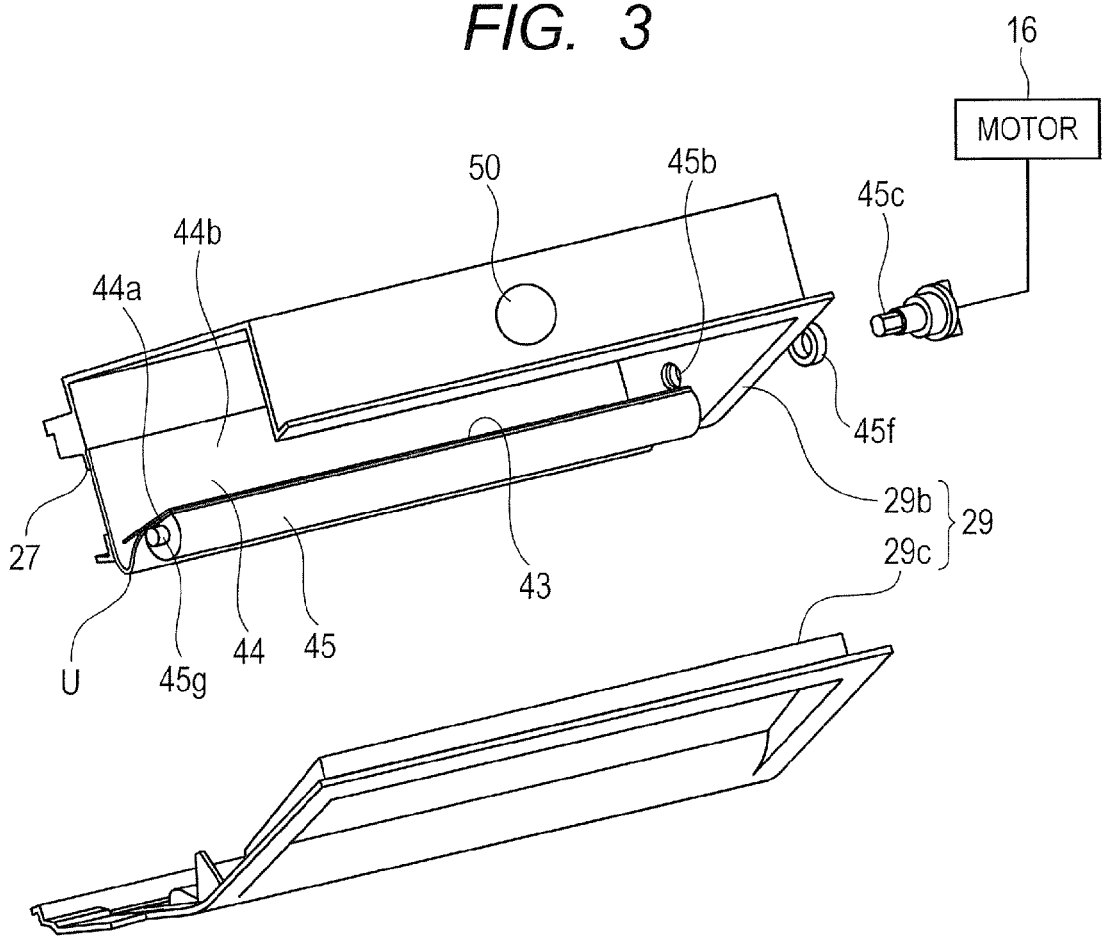
FIG. 3 is an exploded perspective view for illustrating a state in which a container body and a lid member, which are two frame bodies of the developer container, are separated from each other.
Figure 4:
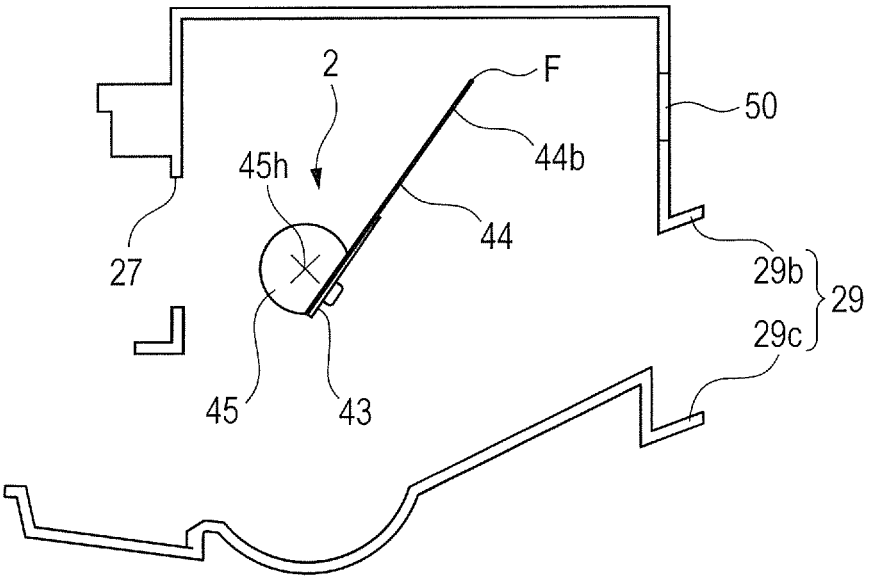
FIG. 4 is an exploded sectional view for illustrating the state in which the container body and the lid member, which are the two frame bodies of the developer container, are separated from each other.

As illustrated in FIG. 3, the sealing portion 44*b* of the sealing member 44 is bonded to the bonding region 46 illustrated in FIG. 6, and the rotating member 45 is supported on the container body 29*b* of the developer container 29 in a rotatable manner. In this state, a folded portion U illustrated in FIG. 3 is formed in the sealing member 44. The sealing member 44 is folded along the folded portion U.

The opening 27 formed in the container body 29*b* of the developer container 29 is sealed by bonding the sealing portion 44*b* of the sealing member 44 to the bonding region 46. A drive-side end portion of the stirring unit 2 configured to drive the stirring member 43 serving as the unsealing member to rotate has the following configuration. A stirring gear member 45*c* is inserted into and engaged with an engagement hole portion 45*d* formed in the drive-side end portion of the rotating member 45 illustrated in FIG. 5A and FIG. 5B through a bearing portion 45*f* and a hole portion 45*b* formed of a through-hole formed in the container body 29*b* of the developer container 29 illustrated in FIG. 3.

At a non-drive-side end portion of the stirring unit 2, a rotation shaft 45*g* formed at a non-drive-side end portion of the rotating member 45 as illustrated in FIG. 3 is supported in a rotatable manner on a bearing portion (not shown) provided on the container body 29*b* of the developer container 29. With this configuration, the stirring unit 2 is supported on the container body 29*b* of the developer container 29 so as to be rotatable about a rotation center 45*h* of the rotating member 45 in a direction of the arrow C of FIG. 7A.

After the stirring unit 2 is supported in a rotatable manner on the container body 29*b* of the developer container 29, a lid member 29*c* is fixed to the container body 29*b* of the developer container 29 by welding or the like. After enclosure of an inside of the stirring chamber 1 of the developer container 29 is completed, the toner T is filled through a filling port 50 formed in the container body 29*b* of the developer container 29 illustrated in FIG. 3 and FIG. 4. After that, the filling port 50 is sealed with a lid member or the like (not shown).

Figure 7A:
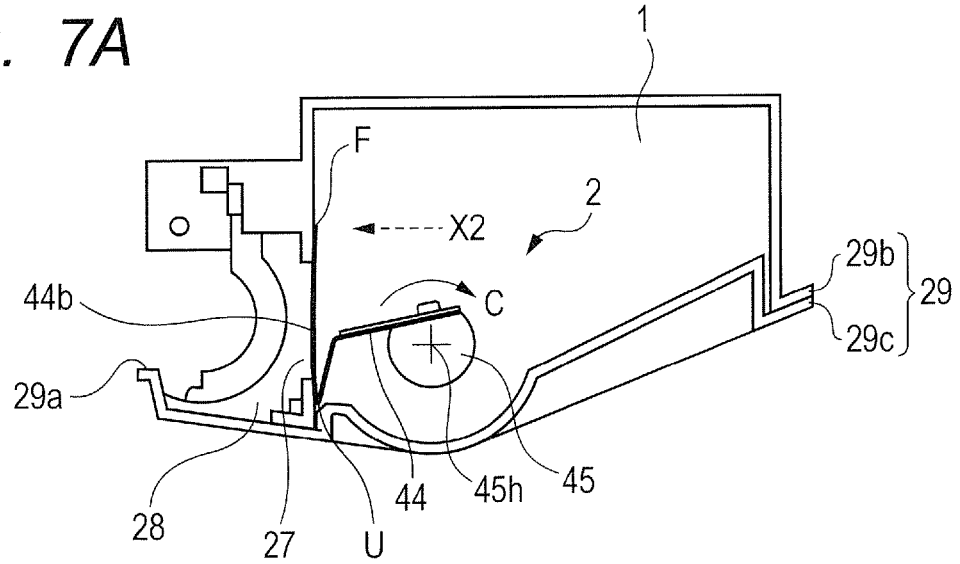
FIG. 7A is an explanatory sectional view for illustrating the developing device.
Figure 7B:
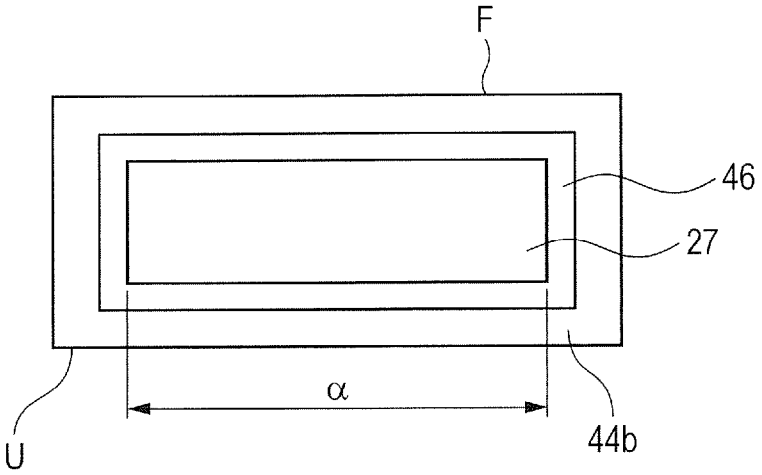
FIG. 7B is an explanatory front view for illustrating a bonded state of the sealing member as viewed from a direction of the arrow X2 of FIG. 7A.
Figure 7C:
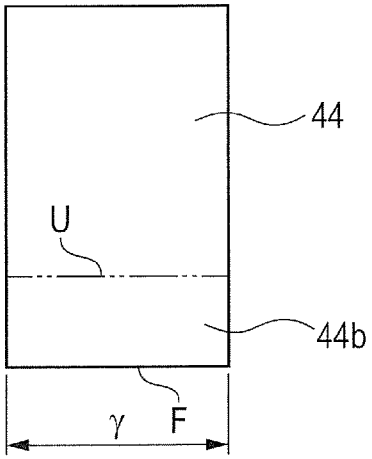
FIG. 7C is an explanatory plan view for illustrating the sealing member.

One mode of bonding the sealing member 44 is described. FIG. 7A is an explanatory sectional view for illustrating the developing device according to this embodiment. FIG. 7B is an explanatory front view for illustrating a bonded state of the sealing member as viewed from a direction of the arrow X2 of FIG. 7A. FIG. 7C is an explanatory plan view for illustrating the sealing member according to this embodiment. FIG. 7B is an illustration of the bonding region 46 for the sealing portion 44*b* between the folded portion U of the sealing member 44 illustrated in FIG. 7A and the free end portion F of the sealing member 44 before the sealing portion 44*b* is bonded to the bonding region 46.

A direction parallel to a direction (direction of the arrow C of FIG. 7A) of conveying the developer due to rotation of the stirring unit 2 corresponds to the long-side direction of the sealing member 44 illustrated in FIG. 7C. A direction orthogonal to the direction (direction of the arrow C of FIG. 7A) of conveying the developer due to rotation of the stirring unit 2 corresponds to the short-side direction of the sealing member 44 illustrated in FIG. 7C. As illustrated in FIG. 7A, the sealing portion 44*b* of the sealing member 44 formed in the new process cartridge B is bonded to the bonding region 46. The bonding region 46 is formed in the peripheral edge portion on the stirring chamber 1 side (inner side) of the opening 27 formed in the container body 29*b* of the developer container 29. As illustrated in FIG. 7B, in a bonded state, the sealing portion 44*b* is uniformly bonded to the bonding region 46 over the entire periphery of the opening 27.

<Unsealing Operation>

Figure 8A:
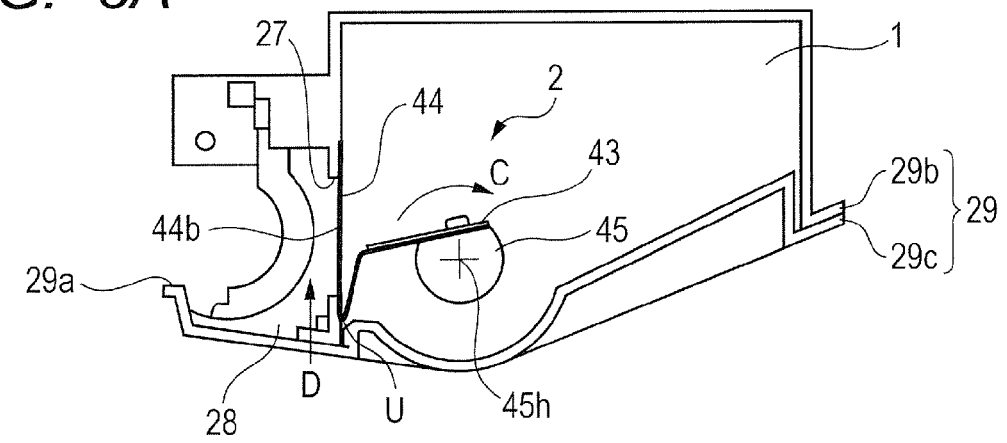
FIG. 8A is an explanatory sectional view for illustrating a state of peeling the sealing member bonded to the peripheral edge portion of the opening formed in the developer container.
Figure 8B:
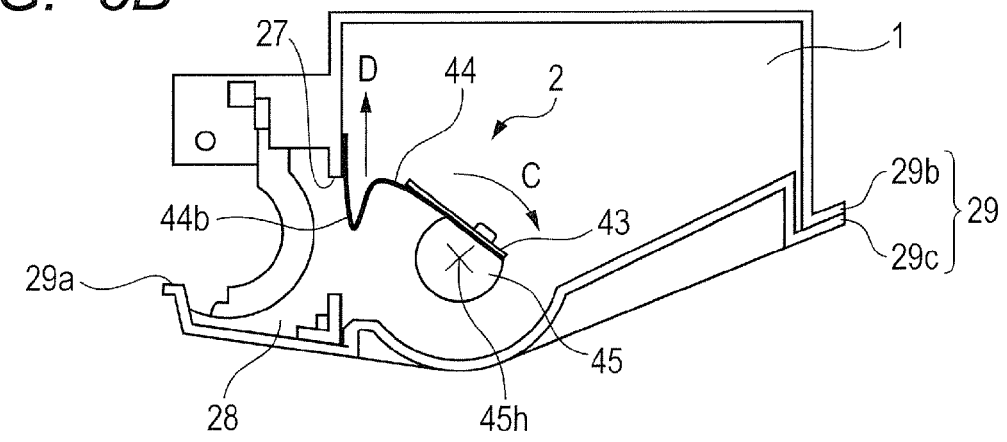
FIG. 8B is an explanatory sectional view for illustrating the state of peeling the sealing member bonded to the peripheral edge portion of the opening formed in the developer container.
Figure 8C:
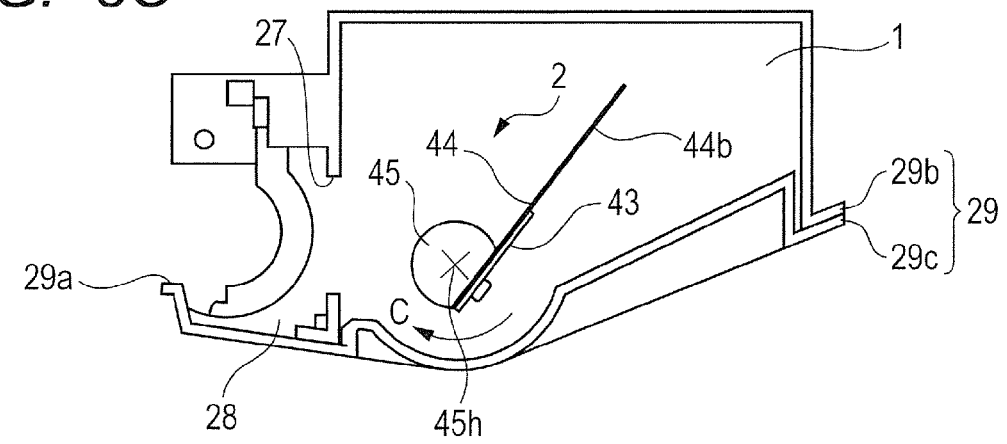
FIG. 8C is an explanatory sectional view for illustrating the state of peeling the sealing member bonded to the peripheral edge portion of the opening formed in the developer container.

Next, with reference to FIG. 8A to FIG. 8C, unsealing operation of the sealing portion 44*b* of the sealing member 44 is described. At the start of initial use of the new process cartridge B, a rotational driving force is transmitted to the rotating member 45 through the stirring gear member 45*c* from a motor 16 that is illustrated in FIG. and mounted on the main body of the image forming apparatus A to serve as a driving source. Thus, the rotating member 45 is rotated about the rotation center 45*h* in a direction of the arrow C of FIG. 8A.

Due to rotation of the rotating member 45, a tensile force generated by tension in a direction of the arrow D of FIG. 8A is applied to the sealing member 44, thereby starting unsealing of the bonding region 46 in the sealing portion 44*b*. Due to rotation of the rotating member 45, the unsealing operation is continuously performed on the sealing member 44 from a state illustrated in FIG. 8A to a state illustrated in FIG. 8B. Then, as illustrated in FIG. 8C, when unsealing of the sealing member 44 is completed, due to rotation of the rotating member 45 in a direction of the arrow C of FIG. 8C, the sealing member 44 keeps rotation in the direction of the arrow C of FIG. 8C together with the sheet-like stirring member 43.

At the start of initial use of the new process cartridge B, the unsealing operation for the sealing portion 44*b* of the sealing member 44 is performed. Due to rotation of the rotating member 45 in the direction of the arrow C of FIG. 8C, the toner T stored in the stirring chamber 1 is conveyed through the opening 27 into the developing chamber 28 while being stirred by the stirring member 43. In this manner, the inside of the developing chamber 28 having the developing sleeve 32 arranged therein is filled with the toner T. Thus, preparation for image formation is made.

A width α of the opening 27 of the container body 29*b* of the developer container 29, in the long-side direction thereof (axial direction of the rotating member 45) illustrated in FIG. 7B is set to be smaller than a width γ of the sealing member 44 in the short-side direction thereof illustrated in FIG. 7C. This is because, when the sealing member 44 intrudes into the developing chamber 28 through the opening 27, the sealing member 44 disturbs the toner T having a predetermined thickness and carried on the surface of the developing sleeve 32.

The width α of the opening 27 in the long-side direction illustrated in FIG. 7B and the width γ of the sealing member 44 in the short-side direction illustrated in FIG. 7C are set to satisfy a relationship expressed by Expression 1 below. For example, the width α of the opening 27 in the long-side direction is approximately 210 mm, and the width γ of the sealing member 44 in the short-side direction is approximately 212 mm. It is only necessary that the width γ of the sealing member 44 in the short-side direction be larger than the width α of the opening 27 in the long-side direction, and that a margin for bonding be secured.

$$\alpha<\gamma \qquad \text{[Expression 1]}$$

<Remanufacturing Method>

With reference to FIG. 9A to FIG. 9D, description is made of a method of remanufacturing the process cartridge B that has been used to reach the end of a predetermined life and has used up the toner T. First, the used process cartridge B that has used up the toner T is taken out of the main body of the image forming apparatus A illustrated in FIG. 1. Next, the process cartridge B illustrated in FIG. 2 is disassembled. At this time, first, a cleaning unit 17 and the developing device 20 of the process cartridge B illustrated in FIG. 2 are separated from each other. The cleaning unit 17 and the developing device 20 are coupled to each other in a pivotable manner by a coupling unit (not shown), e.g., a shaft member. The shaft member (not shown) is removed, thereby being capable of easily separating the cleaning unit 17 and the developing device 20 of the process cartridge B from each other.

Figure 9A:
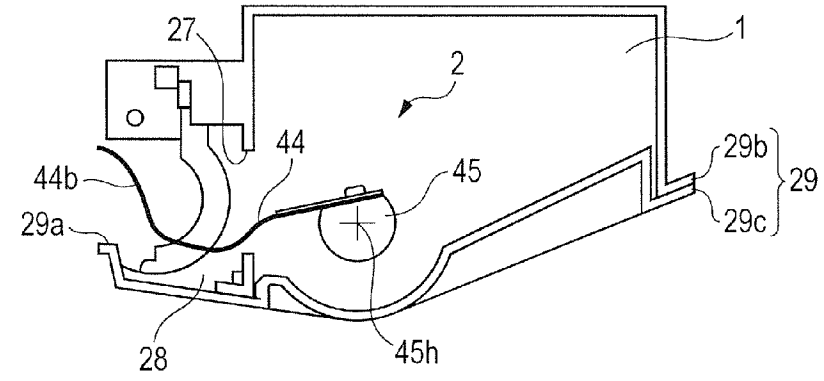
FIG. 9A is an explanatory sectional view for illustrating a state of pulling out the sealing member through the opening and peelably bonding the sealing member to the peripheral edge portion of the opening from an outer side of the opening in the first embodiment.

As illustrated in FIG. 9A, the developing sleeve and the magnet roller 34 are taken out through an opening 29*a* formed in the container body 29*b* of the developer container 29 of the separated developing device 20. In addition, the developing blade 42 is removed, which is fixed with a screw to a peripheral edge portion of the opening 29*a* formed in the container body 29*b* of the developer container 29. In this embodiment, it is difficult to separate the frame bodies formed of the container body 29*b* and the lid member 29*c* of the developer container 29 bonded to each other. Thus, separation of the frame bodies is not performed.

Next, through the opening 29*a* formed in the container body 29*b* of the developer container 29, the air or the like is blown to an inside of the empty developer container 29 that has used up the toner T. Thus, a slight amount of the toner T remaining inside the developer container 29 is discharged through the openings 27 and 29*a* together with the air. Next, as illustrated in FIG. 9A, the rotating member 45 is rotated as appropriate, thereby pulling out the sealing portion 44*b* side being an open end portion of the sealing member 44 through the openings 27 and 29*a*. As expressed in Expression 1, the width γ of the sealing member 44 in the short-side direction is larger than the width α of the opening 27 in the long-side direction. Accordingly, while both end portions of the sealing member 44 having the width γ in the short-side direction are slightly bent toward a center side of the sealing member 44, the sealing portion 44*b* side being the open end portion of the sealing member 44 is pulled out through the openings 27 and 29*a*.

Next, under a state in which the sealing portion 44*b* side being the open end portion of the sealing member is pulled out through the openings 27 and 29*a*, the openings 27 and 29*a* are oriented upward, and the desired new toner T is filled into the developer container 29 through the openings 27 and 29*a*. An opening area of each of the openings 27 and 29*a* formed over a substantially entire length of the developer container 29 in a long-side direction thereof is larger than an opening area of the substantially circular filling port 50 formed in the container body 29*b* of the developer container 29 illustrated in FIG. 3. Accordingly, the toner T can be filled quickly.

Figure 9B:
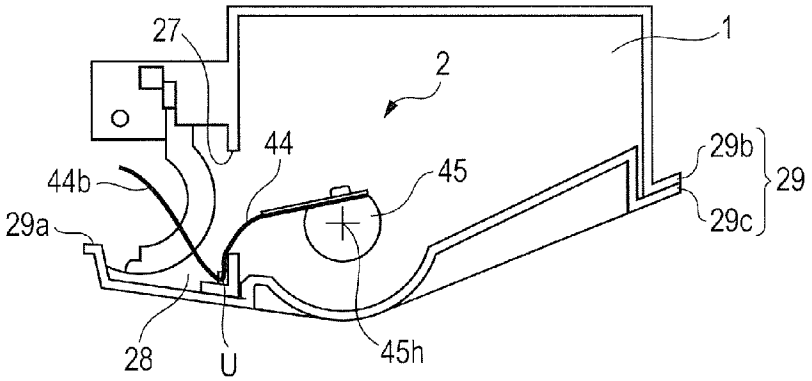
FIG. 9B is an explanatory sectional view for illustrating the state of pulling out the sealing member through the opening and peelably bonding the sealing member to the peripheral edge portion of the opening from the outer side of the opening in the first embodiment.
Figure 9C:
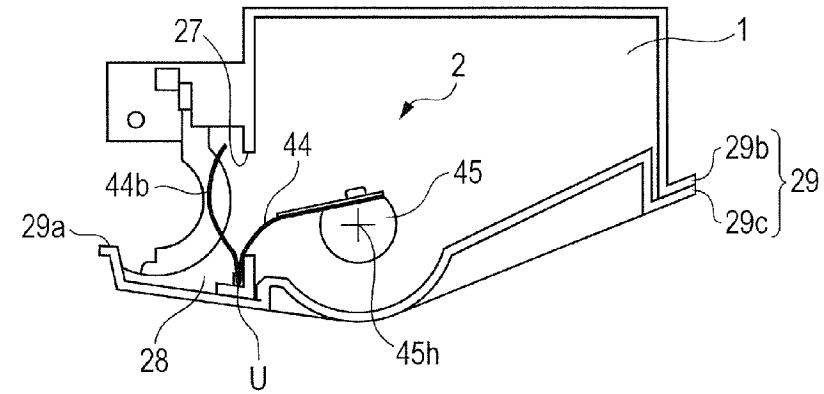
FIG. 9C is an explanatory sectional view for illustrating the state of pulling out the sealing member through the opening and peelably bonding the sealing member to the peripheral edge portion of the opening from an outer side of the opening in the first embodiment.

Next, as illustrated in FIG. 9B, the sealing portion 44*b* to be the open end portion of the sealing member 44 pulled out through the opening 27 is peelably bonded to an outer peripheral edge of a lower side of the opening 27 on the developing chamber 28 side again. As illustrated in FIG. 9B, the sealing member 44 is folded along the folded portion U. Next, as illustrated in FIG. 9C, a folded part of the sealing member 44 is overlaid and bonded on a surface on the developing chamber 28 side of the sealing member 44 bonded to the outer peripheral edge of the lower side of the opening 27.

Figure 9D:
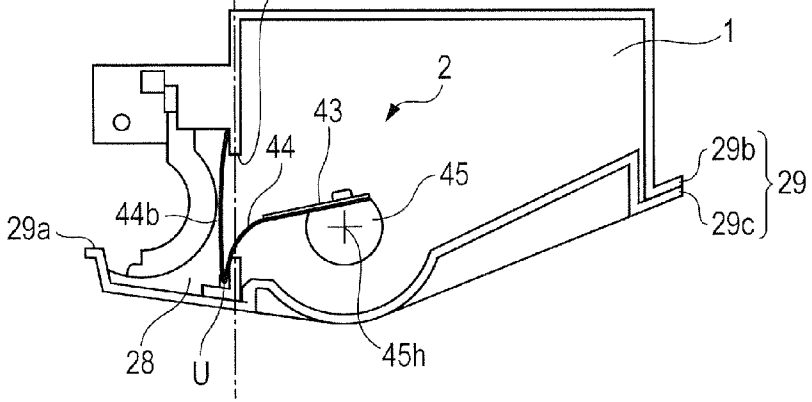
FIG. 9D is an explanatory sectional view for illustrating the state of pulling out the sealing member through the opening and peelably bonding the sealing member to the peripheral edge portion of the opening from an outer side of the opening in the first embodiment.

Finally, as illustrated in FIG. 9D, the sealing portion 44*b* on the free end portion side of the sealing member 44 is peelably bonded to outer peripheral edges of right, left, and upper sides of the opening 27 on the developing chamber 28 side. In this embodiment, assuming that the opening 27 is a boundary M, the sealing portion 44*b* that is a part of the sealing member 44 is peelably bonded to the outer peripheral edges of the opening 27 on the opposite side of the stirring unit 2 including the stirring member 43 serving as the unsealing member.

Along with moving operation (rotating operation in this embodiment) of the stirring unit 2, the sealing member 44 is peeled from the outer peripheral edges of the opening 27, thereby unsealing the opening 27. Other than the rotating operation, operation of moving the unsealing member away from the opening 27 may be adopted as the moving operation of the unsealing member. Regarding the stirring member 43 serving as the unsealing member, the unsealing member and the stirring member may be formed of separate members.

Figure 10A:
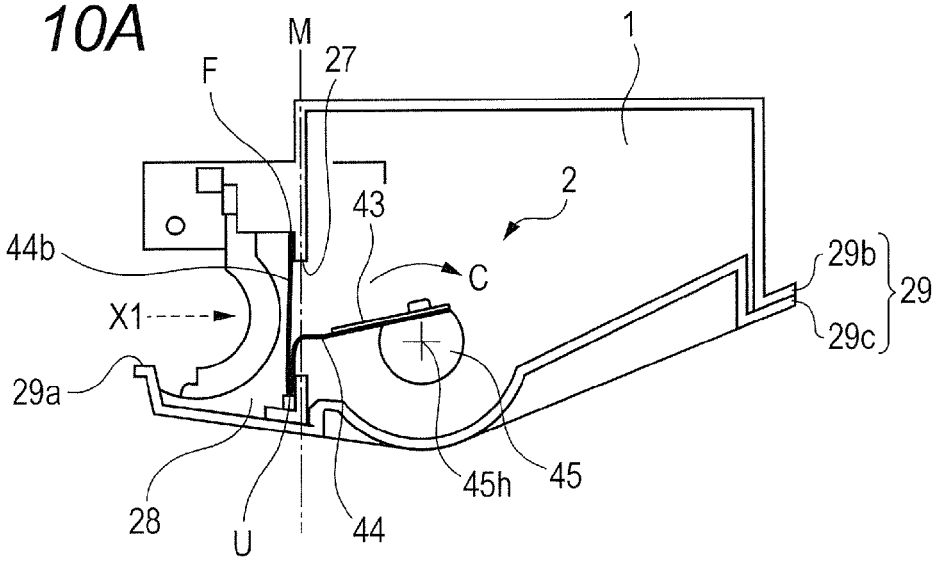
FIG. 10A is an explanatory sectional view for illustrating the developing device including the developer container according to the first embodiment of the present invention.
Figure 10B:
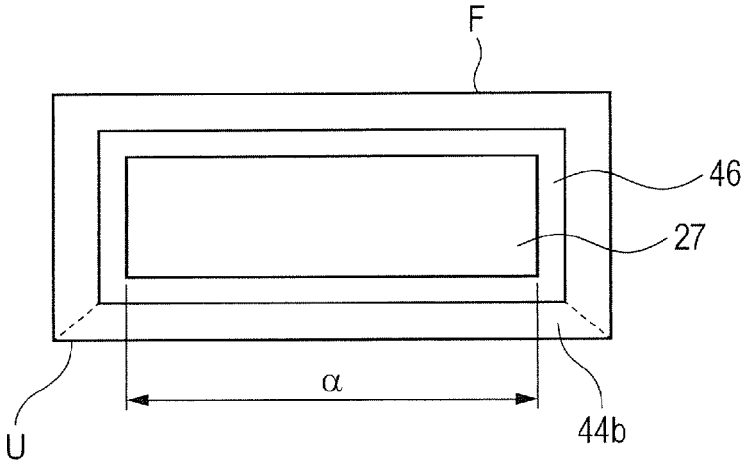
FIG. 10B is an explanatory front view for illustrating a bonded state of the sealing member as viewed from a direction of the arrow X1 of FIG. 10A.
Figure 10C:
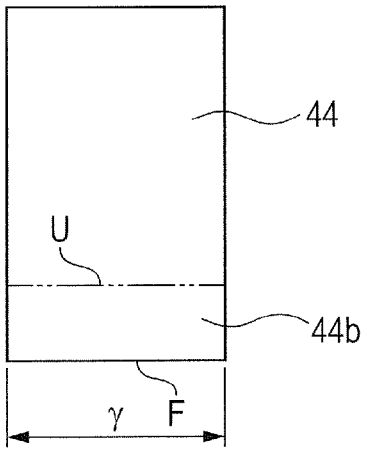
FIG. 10C is an explanatory plan view for illustrating the sealing member according to the first embodiment.

FIG. 10A is an explanatory sectional view for illustrating the developing device 20 including the developer container 29 according to this embodiment. FIG. 10B is an illustration of a state in which the sealing portion 44*b* to be the open end portion of the sealing member 44 is bonded to the bonding region 46 of the outer peripheral edges of the opening 27 on the developing chamber 28 side. FIG. 10C is an explanatory plan view for illustrating the sealing member 44 according to this embodiment. As illustrated in FIG. 10A and FIG. 10B, when the developer container 29 is remanufactured, the sealing portion 44*b* to be the open end portion of the sealing member 44 pulled out through the opening 27 is peelably bonded to the outer peripheral edges of the opening 27 on the developing chamber 28 side (outer side) again. As the bonding method, thermal re-welding or bonding with a double-sided adhesive tape is adopted.

When the sealing portion 44*b* of the sealing member 44 is bonded to the bonding region 46 of the outer peripheral edges of the opening 27 on the developing chamber 28 side as in this embodiment, the following influence is exerted. High torque is needed when the sealing member 44 is reeled up by the rotating member 45 in order to peel the sealing portion 44*b*. Accordingly, adhesive strength which is sufficient to enable the sealing portion 44*b* to be peeled is selected as appropriate in a case of bonding the sealing portion 44*b*.

Next, the developing sleeve 32, the magnet roller 34, and the developing blade 42 illustrated in FIG. 2 are mounted to the remanufactured developing device 20, and the cleaning unit 17 is mounted thereto, thereby assembling the process cartridge B. When components are extremely soiled, the components are replaced as appropriate. Next, the remanufactured process cartridge B is mounted to the main body of the image forming apparatus A illustrated in FIG. 1.

In this embodiment, the used sealing member 44 is reused, thereby being capable of remanufacturing the process cartridge B at low cost. Further, from an outer side of the opening 27 formed in the container body 29*b* of the developer container 29, the sealing portion 44*b* of the used sealing member 44 is bonded to the bonding region 46 of the outer peripheral edges of the opening 27 on the developing chamber 28 side. Thus, the process cartridge B can be remanufactured by the simple remanufacturing method.

In this embodiment, the toner T can be filled into the developer container 29 using the opening 29*a* of the developer container 29 in which the developing sleeve 32 is to be arranged. The opening 27 is formed between the stirring chamber 1 and the developing chamber 28 communicated with the opening 29*a*. From the outer side of the opening 27, the sealing portion 44*b* of the sealing member 44 is bonded to the bonding region 46 of the outer peripheral edges of the opening 27 on the developing chamber 28 side, thereby being capable of sealing the opening 27.

The sealing member 44 is reeled up by rotation of the rotating member 45 arranged inside the developer container 29 to unseal the opening 27 sealed by the sealing portion 44*b*. In the developing device 20, the opening 27 is sealed by the sealing portion 44*b* of the sealing member 44 after the toner T is filled into the developer container 29 using the opening 27. In this case, the toner T is filled and the opening 27 is sealed by the sealing portion 44*b* of the sealing member 44 after the container body 29*b* and the lid member 29*c* of the developer container 29 are assembled together in advance.

In this embodiment, the opening 27 is sealed by the sealing portion 44*b* of the sealing member 44 from the outer side of the opening 27. Thus, the toner T can be filled through the opening 27 after the container body 29*b* and the lid member 29*c* of the developer container 29 are combined together. Further, the toner T is filled into the developer container 29 using the opening 27 that is widely opened over a substantially entire length of the developing sleeve 32 in a long-side direction thereof, thereby being capable of increasing filling speed.

The sealing member 44 is reeled up by rotation of the rotating member 45 arranged inside the developer container 29 to unseal the opening 27 sealed by the sealing portion 44*b*. During remanufacture of the developing device 20, from the outer side of the opening 27 of the developer container 29, the sealing portion 44*b* of the sealing member is bonded to the bonding region 46 of the outer peripheral edges of the opening 27 on the developing chamber 28 side. Thus, the toner T can be sealed easily without separating the container body 29*b* and the lid member 29*c* of the developer container 29 from each other.

Second Embodiment

Figure 11A:
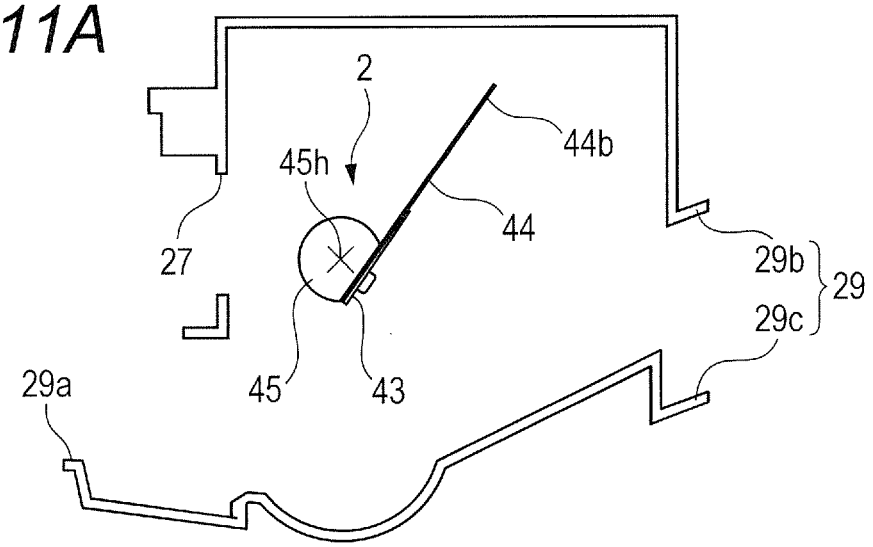
FIG. 11A is an exploded sectional view for illustrating a state in which a container body and a lid member of a developer container, which are two frame bodies of the developer container, are separated from each other according to a second embodiment of the present invention.
Figure 11B:
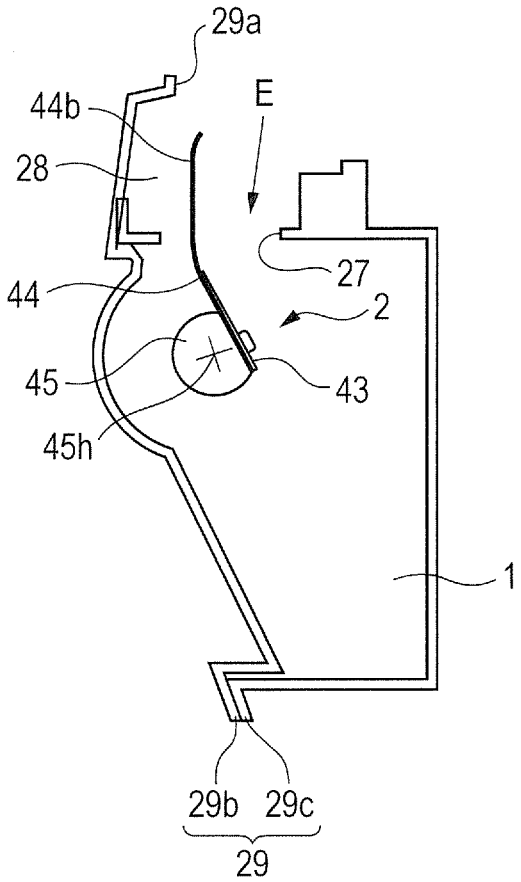
FIG. 11B is an explanatory sectional view for illustrating a state in which developer is filled from an outer side of an opening after the sealing member is pulled out through the opening.

With reference to FIG. 11A and FIG. 11B, description is made of an image forming apparatus including a developer container, a developing device, and a process cartridge, which are removably mounted, according to a second embodiment of the present invention. The same components as those of the first embodiment are denoted by the same reference symbols. Alternatively, the same terms are used even when the components are denoted by different reference symbols, and description thereof is omitted.

In the first embodiment, the example of the case of reusing the sealing member 44 on the premise that the process cartridge B is remanufactured is described. In this embodiment, when the process cartridge B is in a new condition, the toner T is filled into the developer container 29 using the openings 29*a* and 27 that are each widely opened over the substantially entire length of the developing sleeve 32 in the long-side direction. Then, description is made of a case of bonding the sealing portion 44*b* of the sealing member 44 to the bonding region 46 of the outer peripheral edges of the opening 27 on the developing chamber 28 side. Description overlapping the description of the first embodiment is omitted.

<Mounting of Stirring Unit 2>

FIG. 11A is an exploded sectional view for illustrating a state in which the container body 29*b* and the lid member 29*c* of the developer container 29 according to the second embodiment, which are two frame bodies of the developer container 29, are separated from each other. FIG. 11B is an explanatory sectional view for illustrating a state in which, while the sealing member 44 is pulled out through the opening 27, the toner T is filled from the outer side of each of the openings 29*a* and 27. As illustrated in FIG. 11A, also in this embodiment, similarly to the first embodiment, the stirring unit 2 is mounted to the container body 29*b* of the developer container 29. In this embodiment, before the sealing portion 44*b* of the sealing member 44 is bonded to the bonding region 46 of the outer peripheral edges of the opening 27 on the developing chamber 28 side, the container body 29*b* and the lid member 29*c* of the developer container 29 are bonded to each other by welding or the like.

Next, as illustrated in FIG. 11B, the sealing portion 44*b* on the open end portion side of the sealing member 44 is pulled out through the opening 27. In this state, the openings 29*a* and 27 of the developer container 29 are oriented upward, and the toner T is filled into the developer container 29 through the openings 29*a* and 27 in a direction of the arrow E of FIG. 11B.

In this embodiment, the toner T is filled into the stirring chamber 1 of the developer container 29 through the openings 29*a* and 27 of the developer container 29. Accordingly, unlike the first embodiment illustrated in FIG. 3, it is not necessary to separately form the filling port 50 in the container body 29*b* of the developer container 29. An opening area of each of the openings 29*a* and 27, which is widely opened over the substantially entire length of the developing sleeve 32 in the long-side direction, is larger than an opening area of the filling port 50 illustrated in FIG. 3. Accordingly, the toner T can be quickly filled into the developer container 29 through the openings 29*a* and 27. After filling of the toner T is completed, as illustrated in FIG. 9A to FIG. 9D, similarly to the remanufacturing method according to the first embodiment, the sealing portion 44*b* of the sealing member 44 is bonded to the bonding region 46 of the outer peripheral edges of the opening 27 on the developing chamber 28 side, thereby sealing the opening 27.

In this embodiment, when the process cartridge B is in a new condition, the toner T can be filled into the developer container 29 at high filling speed using the openings 29*a* and 27 that are each widely opened over the substantially entire length of the developing sleeve 32 in the long-side direction. In order to fill the toner T into the developer container 29, it is not necessary to separately form the filling port 50 in the container body 29*b* of the developer container 29. Accordingly, rigidity of the developer container 29 can be maintained. The other configuration is the same as that of the first embodiment, and the same effects can be obtained.

Third Embodiment

Figure 12A:
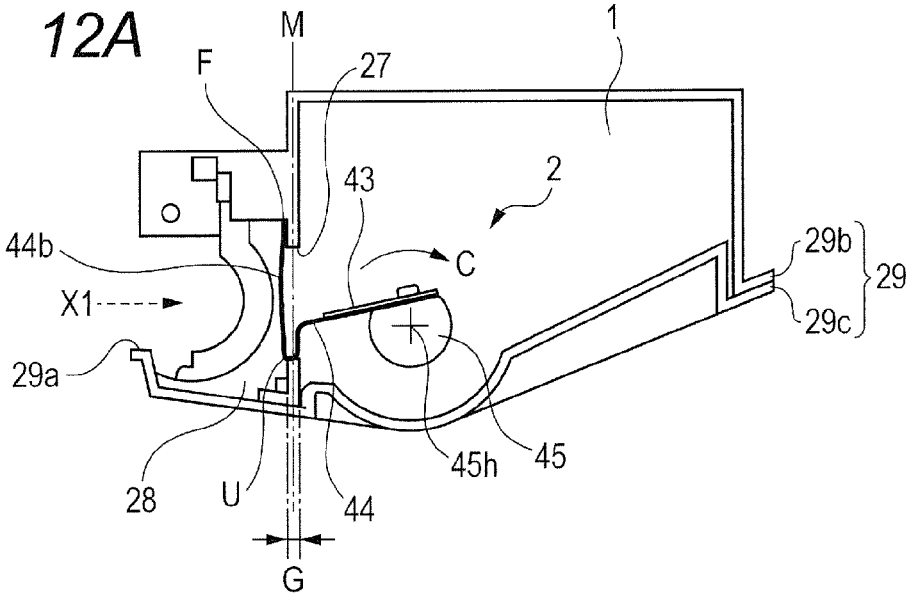
FIG. 12A is an explanatory sectional view for illustrating a developing device including a developer container according to a third embodiment of the present invention.
Figure 12B:
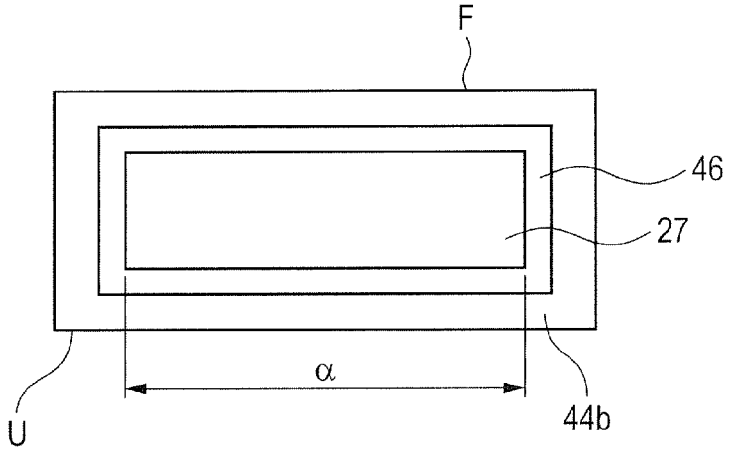
FIG. 12B is an explanatory front view for illustrating a bonded state of a sealing member as viewed from a direction of the arrow X1 of FIG. 12A.
Figure 12C:
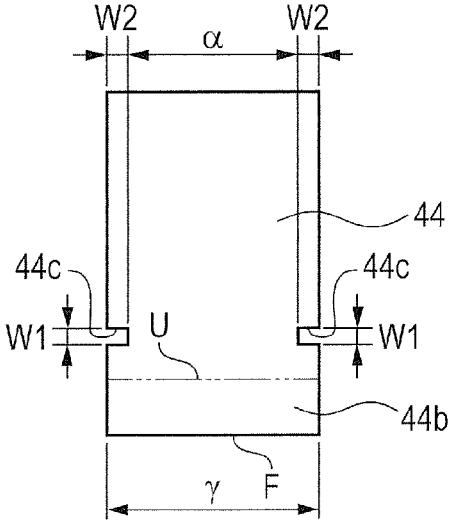
FIG. 12C is an explanatory plan view for illustrating the sealing member according to the third embodiment.

With reference to FIG. 12A to FIG. 12C, description is made of an image forming apparatus including a developer container, a developing device, and a process cartridge, which are removably mounted, according to a third embodiment of the present invention. The same components as those of the above-mentioned embodiments are denoted by the same reference symbols. Alternatively, the same terms are used even when the components are denoted by different reference symbols, and description thereof is omitted. FIG. 12A is an explanatory sectional view for illustrating the developing device including the developer container according to the third embodiment of the present invention. FIG. 12B is an explanatory front view for illustrating a bonded state of a sealing member as viewed from a direction of the arrow X1 of FIG. 12A. FIG. 12C is an explanatory plan view for illustrating the sealing member according to the third embodiment.

As illustrated in FIG. 12C, the sealing member 44 according to this embodiment is formed of a flexible sheet-like member. A pair of rectangular cutout portions 44*c* is formed in both long sides of the sealing member 44, respectively. A width W1 of each of the cutout portions 44*c* in the long-side direction of the sealing member 44 is set to correspond to a thickness G of a wall portion of the container body 29*b* of the developer container 29 having the opening 27 formed therein.

A width W2 of each of the cutout portions 44*c* in the short-side direction of the sealing member 44 is set to a length enabling a part of each of right and left wall portions of the container body 29*b* of the developer container 29 having the opening 27 formed therein to enter each cutout portion 44*c*. The width W2 of each cutout portion 44*c* in the short-side direction of the sealing member 44 is approximately 1 cm. A bonding margin for bonding the sealing member 44 to the edges of the opening 27 is designed so as to prevent the sealing member 44 from projecting through the opening 27 to the developing sleeve 32 side after the opening 27 is unsealed.

As illustrated in FIG. 12A, the opening 27 formed in the container body 29*b* of the developer container 29 is sealed by the sealing portion 44*b* of the sealing member 44. In this state, a part of the sealing member 44 corresponding to the opening 27 has a width that is equal to or smaller than the width $\alpha$ of the opening 27 in a direction (lateral direction of FIG. 12B and FIG. 12C) orthogonal to the direction (direction of the arrow C of FIG. 12A) of conveying the developer by the stirring unit 2. The remaining part of the sealing member 44 has a width $\gamma$ larger than the width $\alpha$ of the opening 27. In this embodiment, the pair of rectangular cutout portions 44*c* is formed in the part of the sealing member 44 corresponding to the opening 27.

<Remanufacture>

A process of discharging the toner T from the new process cartridge B proceeds similarly to the first embodiment. As illustrated in FIG. 12A, in this embodiment, the hole portions 44*a*, which are formed in one end portion of the sealing member 44 in the long-side direction to serve as the fixing portions, are fitted to the shaft portions 45*a* of the rotating member 45 and fixed thereto by thermal caulking. Further, as illustrated in FIG. 12A, under a state in which the sealing portion 44*b* provided at another end portion of the sealing member 44 in the long-side direction is bonded to the bonding region 46 of a wall surface (wall surface defining the opening 27) below the opening 27, the folded portion U is formed. The sealing member 44 is folded along the folded portion U.

Similarly to the first embodiment illustrated in FIG. 7C, the maximum width $\gamma$ of the sealing member 44 in the short-side direction is set to be larger than the width $\alpha$ of the opening 27 of the container body 29*b* of the developer container 29 in the long-side direction. The cutout portions 44*c* are formed in vicinities of the folded portion U of the sealing member 44 according to this embodiment.

During remanufacture, the sealing portion 44*b* on the free end portion side of the sealing member 44 is pulled out through the opening 27. At this time, the cutout portions 44*c* are fitted to right and left wall portions defining the opening 27 of the container body 29*b* of the developer container 29, thereby avoiding interference between the container body 29*b* and the sealing member 44. Further, the sealing member 44 is smoothly folded along the folded portion U, and the sealing portion 44*b* is bonded to the bonding region 46 of the outer peripheral edges of the opening 27 on the developing chamber 28 side. In this manner, the opening 27 can be sealed. A method and the like of bonding the sealing portion 44*b* of the sealing member 44 are the same as those of the first embodiment. Thus, redundant description is omitted.

Also in this embodiment, assuming that the opening 27 illustrated in FIG. 12A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, the used sealing member 44 is reused for remanufacture, thereby being capable of achieving reduction in cost. Further, from the outer side of the opening 27 formed in the container body 29*b* of the developer container 29, the sealing portion 44*b* of the sealing member 44 is bonded to the bonding region 46 of the outer peripheral edges of the opening 27 on the developing chamber 28 side. In this manner, the opening 27 can be sealed. Still further, the cutout portions 44*c* are formed in the vicinities of the folded portion U of the sealing member 44.

With this configuration, the cutout portions 44*c* are fitted to the right and left wall portions defining the opening 27 of the container body 29*b* of the developer container 29, thereby avoiding interference between the container body 29*b* and the sealing member 44. Further, the sealing member 44 is smoothly folded along the folded portion U, and the sealing portion 44*b* is easily bonded to the bonding region 46 of the outer peripheral edges of the opening 27 on the developing chamber 28 side. In this manner, the opening 27 can be sealed. Note that, this embodiment is also applicable to a new condition of the process cartridge B. The other configuration is the same as those of the above-mentioned embodiments, and the same effects can be obtained.

Fourth Embodiment

Figure 13A:
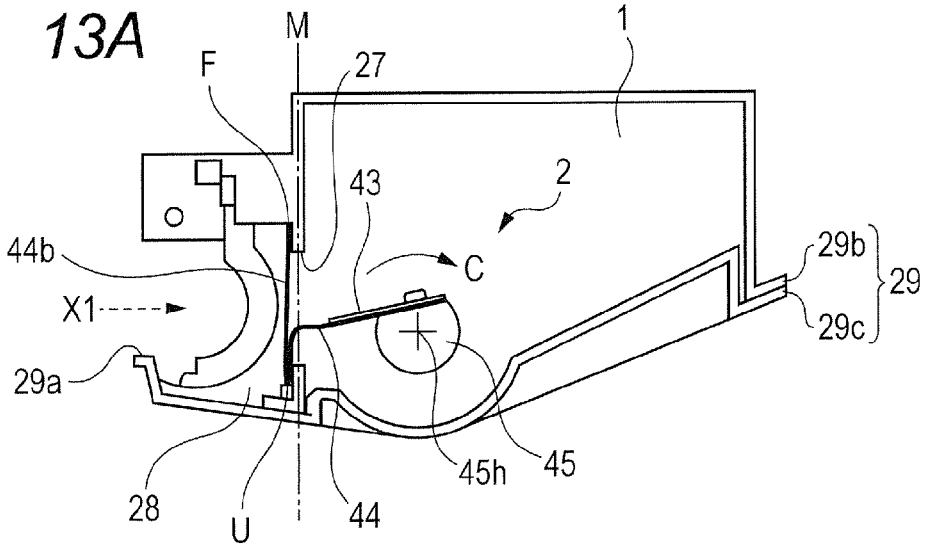
FIG. 13A is an explanatory sectional view for illustrating a developing device including a developer container according to a fourth embodiment of the present invention.
Figure 13B:
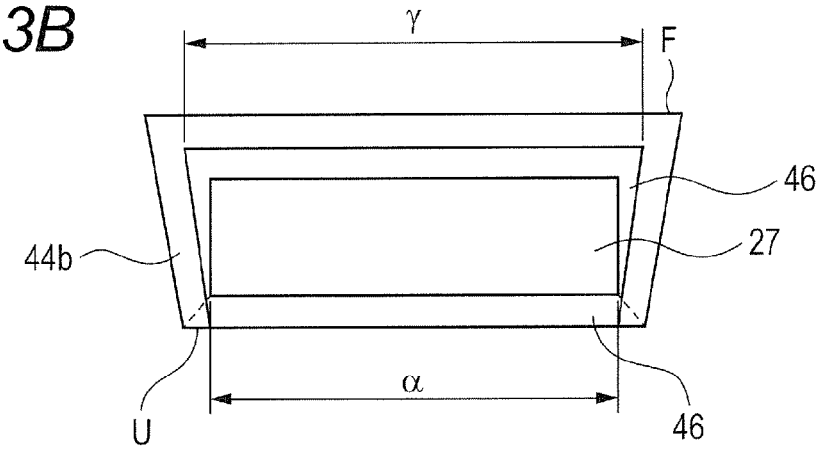
FIG. 13B is an explanatory front view for illustrating a bonded state of a sealing member as viewed from a direction of the arrow X1 of FIG. 13A.
Figure 13C:
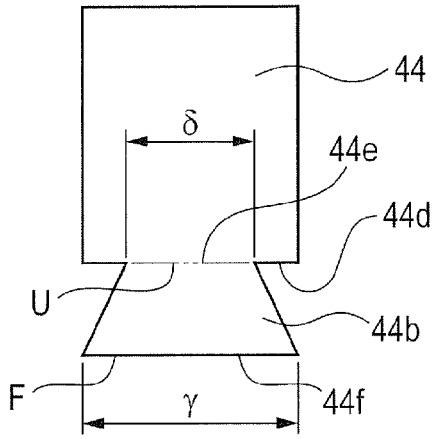
FIG. 13C is an explanatory plan view for illustrating the sealing member according to the fourth embodiment.

With reference to FIG. 13A to FIG. 13C, description is made of an image forming apparatus including a developer container, a developing device, and a process cartridge, which are removably mounted, according to a fourth embodiment of the present invention. The same components as those of the above-mentioned embodiments are denoted by the same reference symbols. Alternatively, the same terms are used even when the components are denoted by different reference symbols, and description thereof is omitted. FIG. 13A is an explanatory sectional view for illustrating the developing device including the developer container according to the fourth embodiment of the present invention. FIG. 13B is an explanatory front view for illustrating a bonded state of a sealing member as viewed from a direction of the arrow X1 of FIG. 13A. FIG. 13C is an explanatory plan view for illustrating the sealing member according to the fourth embodiment.

As illustrated in FIG. 13C, a pair of right-triangular cutout portions 44*d* is formed in both long sides of the sealing member 44 according to this embodiment. Thus, the sealing portion 44*b* of the sealing member 44 according to this embodiment has a trapezoidal shape. A length δ of a short base 44*e* of the trapezoidal shape of the sealing portion 44*b* is smaller than the length γ of a long base 44*f* of the trapezoidal shape of the sealing portion 44*b* that is equal to the width of the sealing member 44 in the short-side direction. The short base 44*e* of the trapezoidal shape of the sealing portion 44*b* of the sealing member 44 is arranged closer to the rotating member 45 than the long base 44*f*.

As illustrated in FIG. 13B, the width α of the opening 27 in the long-side direction and the length δ of the short base 44*e* of the trapezoidal shape of the sealing portion 44*b* are set to the same length. The length γ of the long base 44*f* of the trapezoidal shape of the sealing portion 44*b* is set to be larger by approximately 1 cm than the width α of the opening 27 in the long-side direction (equal to the length δ of the short base 44*e* of the trapezoidal shape of the sealing portion 44*b*).

<Remanufacture>

A process of discharging the toner T from the new process cartridge B proceeds similarly to the first embodiment. In this embodiment, similarly to the first embodiment, the maximum width γ of the sealing member 44 in the short-side direction is set to be larger than the width α of the opening 27 in the long-side direction illustrated in FIG. 13B.

In this embodiment, during remanufacture, the sealing portion 44*b* on the free end portion side of the sealing member 44 is pulled out through the opening 27. At this time, the cutout portions 44*d* (the short base 44*e* of the sealing portion 44*b* formed into the trapezoidal shape has the length δ equal to the width α of the opening 27 in the long-side direction), are fitted to the right and left wall portions defining the opening 27 of the container body 29*b* of the developer container 29, thereby avoiding interference between the container body 29*b* and the sealing member 44. Further, the sealing member 44 is smoothly folded along the folded portion U, and the sealing portion 44*b* is bonded to the bonding region 46 of the outer peripheral edges of the opening 27 on the developing chamber 28 side. In this manner, the opening 27 can be sealed. A method and the like of bonding the sealing portion 44*b* of the sealing member 44 are the same as those of the first embodiment. Thus, redundant description is omitted.

In this embodiment, during remanufacture, when the sealing portion 44*b* side of the sealing member 44 to be the open end portion is pulled out through the openings 27 and 29*a* as in the first embodiment, it is not necessary to pull out the sealing member 44 while both end portions of the sealing member 44 having the width γ in the short-side direction are slightly bent toward the center side of the sealing member 44. Accordingly, the sealing portion 44*b* side of the sealing member 44 to be the open end portion can easily be pulled out through the openings 27 and 29*a*.

The toner T is filled into the developer container 29 through the openings 29*a* and 27 of the developer container 29. After that, the sealing portion 44*b* of the sealing member 44 is bonded to the bonding region 46 of the outer peripheral edges of the opening 27 on the developing chamber 28 side again. As illustrated in FIG. 13B, the bonding region 46 ranges along outer peripheral edges of the sealing portion 44*b* having the trapezoidal shape. FIG. 13B is an illustration of a state in which the sealing portion 44*b* of the sealing member 44 is bonded to the bonding region 46 of the outer peripheral edges of the opening 27 on the developing chamber 28 side.

Also in this embodiment, assuming that the opening 27 illustrated in FIG. 13A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, the used sealing member 44 is reused for remanufacture, thereby being capable of achieving remanufacture at low cost. Further, the sealing portion 44*b* of the sealing member 44 can easily be bonded from the outer side of the developer container 29 to the bonding region 46 of the outer peripheral edges of the opening 27 on the developing chamber 28 side. In this embodiment, as illustrated in FIG. 13C, there is used the sealing portion 44*b* formed into the trapezoidal shape having two bases different in length in the short-side direction of the sealing member 44. With this configuration, while avoiding interference with the right and left wall portions defining the opening 27 of the container body 29*b* of the developer container 29, the sealing portion 44*b* of the sealing member 44 is easily bonded to the bonding region 46 of the outer peripheral edges of the opening 27 on the developing chamber 28 side. Thus, the process cartridge B can easily be remanufactured. The other components are the same as those of the above-mentioned embodiments, and the same effects can be obtained.

Fifth Embodiment

Figure 14A:
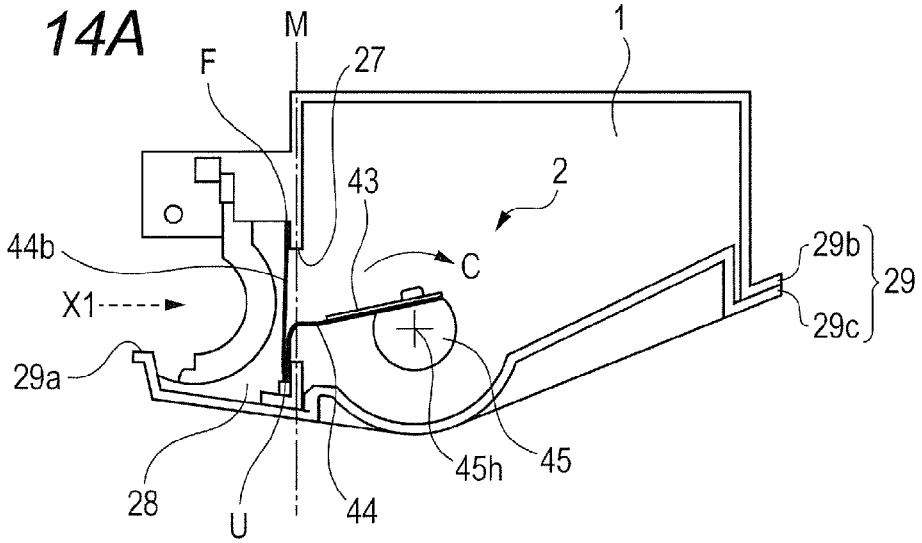
FIG. 14A is an explanatory sectional view for illustrating a developing device including a developer container according to a fifth embodiment of the present invention.
Figure 14B:
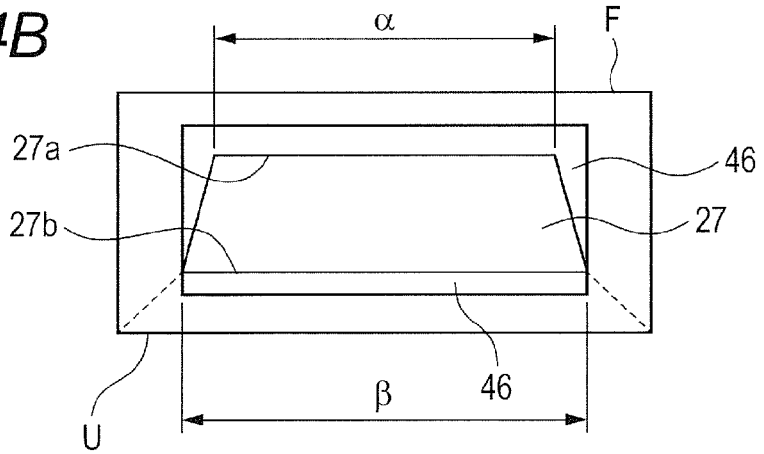
FIG. 14B is an explanatory front view for illustrating a bonded state of the sealing member as viewed from a direction of the arrow X1 of FIG. 14A.
Figure 14C:
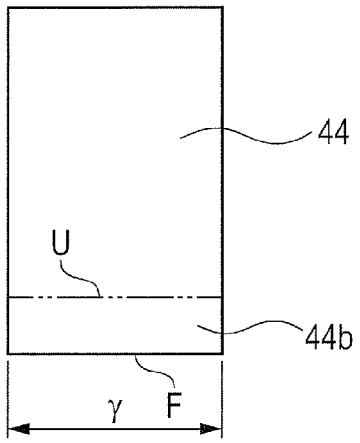
FIG. 14C is an explanatory plan view for illustrating the sealing member according to the fifth embodiment.

Next, with reference to FIG. 14A to FIG. 14C, description is made of an image forming apparatus including a developer container, a developing device, and a process cartridge, which are removably mounted, according to a fifth embodiment of the present invention. The same components as those of the above-mentioned embodiments are denoted by the same reference symbols. Alternatively, the same terms are used even when the components are denoted by different reference symbols, and description thereof is omitted. FIG. 14A is an explanatory sectional view for illustrating the developing device including the developer container according to the fifth embodiment of the present invention. FIG. 14B is an explanatory front view for illustrating a bonded state of the sealing member as viewed from a direction of the arrow X1 of FIG. 14A. FIG. 14C is an explanatory plan view for illustrating the sealing member according to the fifth embodiment.

In this embodiment, as illustrated in FIG. 14B, the opening 27 formed in the container body 29*b* of the developer container 29 has a trapezoidal shape. A downstream side of the trapezoidal shape of the opening 27 in the rotating direction of the stirring unit 2 indicated by the direction of the arrow C of FIG. 14A corresponds to a short base 27*a*, and an upstream side thereof corresponds to a long base 27*b*. As illustrated in FIG. 14C, the sealing member 44 according to this embodiment is formed of a flexible sheet-like member with a rectangular shape. The width γ of the sealing member 44 in the short-side direction is set to be equal to a length β of the long base 27*b* of the trapezoidal shape of the opening 27.

The opening 27 according to this embodiment has the trapezoidal shape having a plurality of sides that are different in width in a direction (lateral direction of FIG. 14B) orthogonal to a direction (direction of the arrow C of FIG. 14A) of conveying the developer by the stirring unit 2. One of the plurality of sides of the opening 27 different in width is as follows. That is, in the direction (lateral direction of FIG. 14B and FIG. 14C) orthogonal to the direction (direction of the arrow C of FIG. 14A) of conveying the developer by the stirring unit 2, one of the plurality of sides of the opening 27 has the width β equal to or larger than the width γ of the rectangular sealing member 44 in the short-side direction. A region of the opening 27 other than the one of the plurality of sides has a width smaller than the width γ of the sealing member 44 in the short-side direction.

<During Image Formation>

In the first embodiment, the width α of the opening 27 in the long-side direction illustrated in FIG. 7B is set to be smaller than the width γ of the sealing member 44 in the short-side direction illustrated in FIG. 7C. By rotation of the rotating member 45, the opening 27 sealed by the sealing portion 44*b* of the sealing member 44 is unsealed. After that, by rotation of the rotating member 45, the sealing portion 44*b* of the sealing member 44 is further rotated as the open end portion. At this time, the sealing member 44 intrudes into the developing chamber 28 through the opening 27. Consequently, there is a fear in that the sealing member 44 disturbs the toner T having a predetermined thickness and carried on the surface of the developing sleeve 32. Accordingly, the sealing member 44 is designed so as not to intrude into the developing chamber 28 through the opening 27.

In this embodiment, similarly to the first embodiment, the region of the opening 27 other than the long base 27*b* of the trapezoidal shape is smaller than the width γ of the sealing member 44 in the short-side direction. Accordingly, when the sealing portion 44*b* of the sealing member 44 is rotated as the open end portion along with rotation of the rotating member 45, the sealing member 44 can be prevented from intruding into the developing chamber 28 through the opening 27.

<Remanufacture>

When the sealing member 44 is pulled out through the opening 27 to the developing chamber 28 side during remanufacture, the sealing portion 44*b* is pulled out from the long base 27*b* of the trapezoidal shape of the opening 27. During remanufacture, when the sealing portion 44*b* side of the sealing member 44 to be the open end portion is pulled out through the openings 27 and 29*a* as in the first embodiment, it is not necessary to pull out the sealing member 44 while both end portions of the sealing member 44 having the width γ in the short-side direction are slightly bent toward the center side of the sealing member 44. Accordingly, the sealing portion 44*b* side of the sealing member 44 to be the open end portion can easily be pulled out through the openings 27 and 29*a*.

The toner T is filled into the developer container 29 through the openings 29*a* and 27 of the developer container 29. After that, the sealing portion 44*b* of the sealing member 44 is bonded to the bonding region 46 of the outer peripheral edges of the opening 27 on the developing chamber 28 side again. Bonding is performed in the same manner as the first embodiment. FIG. 14B is an illustration of a state in which the sealing portion 44*b* of the sealing member 44 is bonded to the bonding region 46 of the outer peripheral edges of the opening 27 on the developing chamber 28 side.

Also in this embodiment, assuming that the opening 27 illustrated in FIG. 14A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, the used sealing member 44 is reused for remanufacture, thereby being capable of achieving remanufacture at low cost. The sealing member 44 is reused by a simple way of bonding the sealing portion 44*b* of the sealing member 44 from the outer side of the developer container 29. As illustrated in FIG. 14B, there is used the opening 27 formed into the trapezoidal shape having the sides different in length in the long-side direction. With this configuration, while preventing intrusion of the sealing member 44 into the developing chamber 28 and avoiding interference with the right and left wall portions defining the opening 27 of the container body 29*b* of the developer container 29, the sealing portion 44*b* of the sealing member 44 is easily bonded to the bonding region 46 of the outer peripheral edges of the opening 27 on the developing chamber 28 side. Thus, the process cartridge B can easily be remanufactured. The other configuration is the same as those of the above-mentioned embodiments, and the same effects can be obtained.

Sixth Embodiment

Figure 15B:
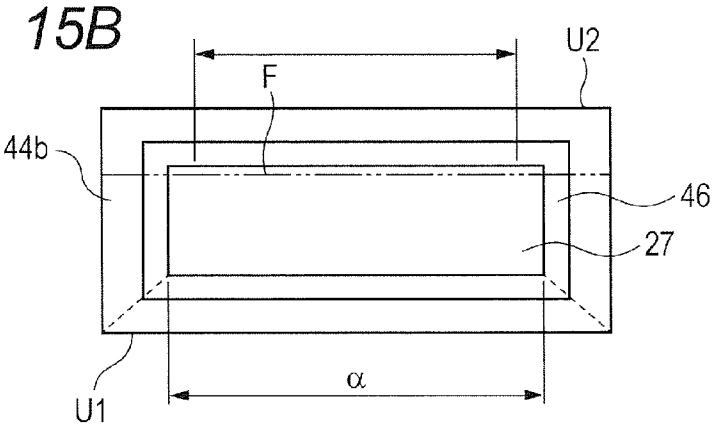
FIG. 15B is an explanatory front view for illustrating a bonded state of a sealing member as viewed from a direction of the arrow X1 of FIG. 15A.
Figure 15A:
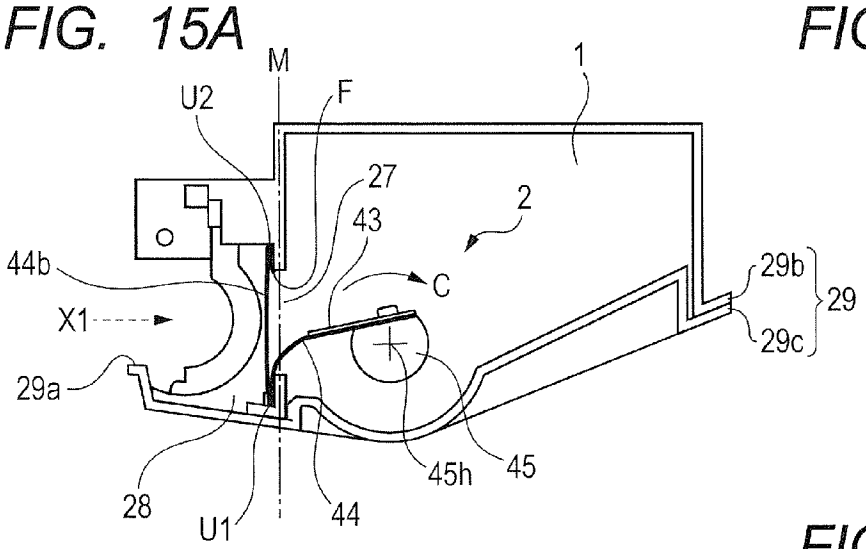
FIG. 15A is an explanatory sectional view for illustrating a developing device including a developer container according to a sixth embodiment of the present invention.
Figure 15D:
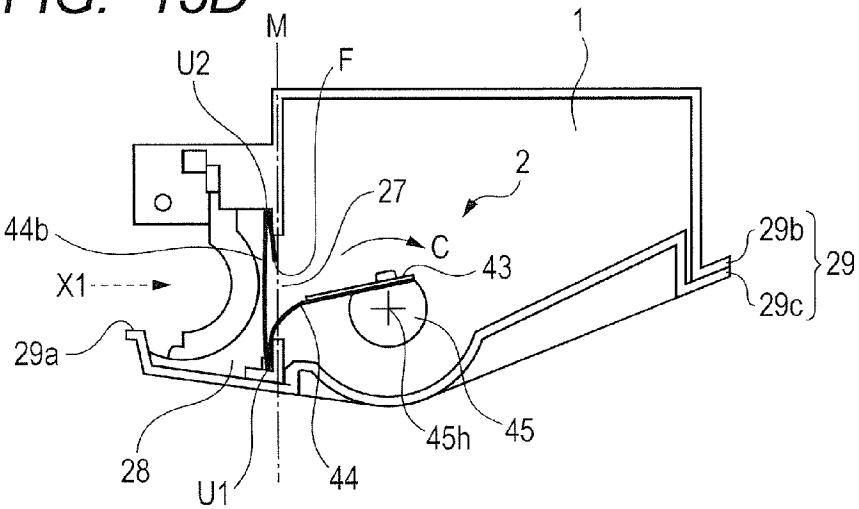
FIG. 15D is a view for illustrating a modified example of FIG. 15A.
Figure 15C:
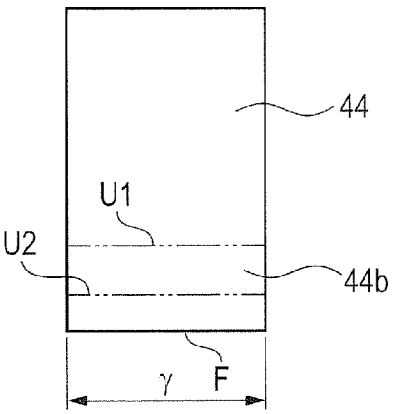
FIG. 15C is an explanatory plan view for illustrating the sealing member according to the sixth embodiment.

With reference to FIG. 15A to FIG. 15D, description is made of an image forming apparatus including a developer container, a developing device, and a process cartridge, which are removably mounted, according to a sixth embodiment of the present invention. The same components as those of the above-mentioned embodiments are denoted by the same reference symbols. Alternatively, the same terms are used even when the components are denoted by different reference symbols, and description thereof is omitted. FIG. 15A is an explanatory sectional view for illustrating the developing device including the developer container according to the sixth embodiment of the present invention. FIG. 15B is an explanatory front view for illustrating a bonded state of a sealing member as viewed from a direction of the arrow X1 of FIG. 15A. FIG. 15C is an explanatory plan view for illustrating the sealing member according to the sixth embodiment. FIG. 15D is a view for illustrating a modified example of FIG. 15A.

In this embodiment, as illustrated in FIG. 15A, a method of bonding the sealing portion 44*b* of the sealing member 44 during remanufacture of the process cartridge B is carried out as follows. As illustrated in FIG. 15A, a folded portion U1 is formed at a portion of the sealing portion 44*b* of the sealing member 44 to be peelably bonded to the peripheral edge of the lower side of the opening 27. In addition, a folded portion U2 is also formed at a portion of the sealing portion 44*b* of the sealing member 44 to be peelably bonded to the peripheral edge of the upper side of the opening 27. This configuration prevents the portion of the sealing portion 44*b* from being shear-peeled at the peripheral edge of the upper side of the opening 27.

As illustrated in FIG. 15D, a length from the folded portion U2 of the sealing member 44 to an end portion of the sealing portion 44*b* can be set to a larger length. A region requiring shear-peeling along the outer peripheral edge of the opening 27 when peeling a bonded portion of the sealing portion 44*b* of the sealing member 44 requires the motor 16 to output maximum torque for driving the rotating member 45 to rotate at the time of peeling the region. A necessary output of the motor 16 is determined in accordance with the maximum torque at this time.

Also in this embodiment, assuming that the opening 27 illustrated in FIG. 15A and FIG. 15D is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, as compared to the first embodiment illustrated in FIG. 10A, there is no region to be shear-peeled in the portion of the sealing portion 44*b* bonded to the peripheral edge of the upper side of the opening 27. Accordingly, the torque of the motor 16 for driving the rotating member 45 to rotate at the time of peeling the region is reduced. Further, the used sealing member 44 is reused, thereby being capable of achieving remanufacture of the process cartridge B at low cost. During remanufacture of the process cartridge B, the sealing portion 44*b* of the sealing member 44 can be bonded to the peripheral edge portion of the opening 27 from the outer side of the opening 27 of the developer container 29. This embodiment is not limited to remanufacture of the process cartridge B, but is also applicable to production of the new process cartridge B. The other components are the same as those of the above-mentioned embodiments, and the same effects can be obtained.

Seventh Embodiment

Figure 16A:
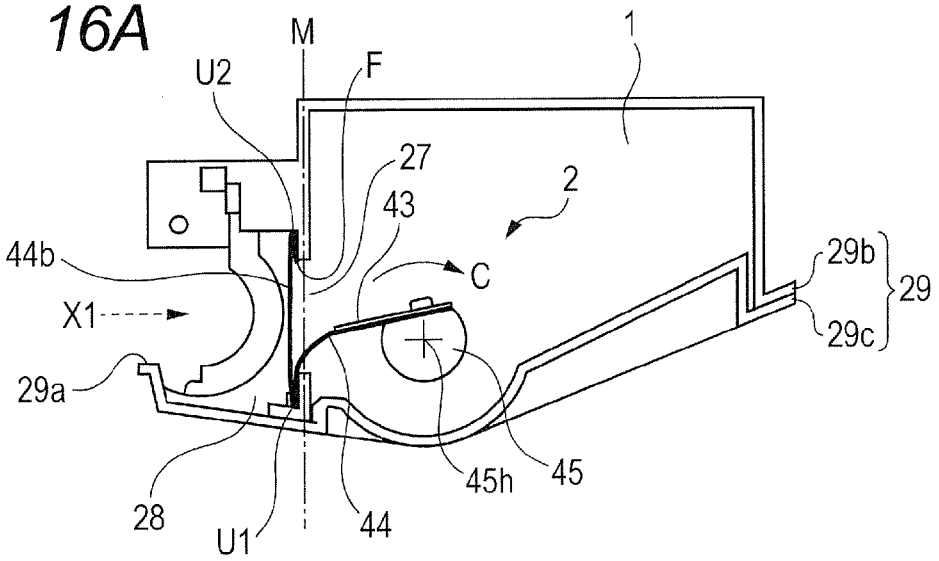
FIG. 16A is an explanatory sectional view for illustrating a developing device including a developer container according to a seventh embodiment of the present invention.
Figure 16B:
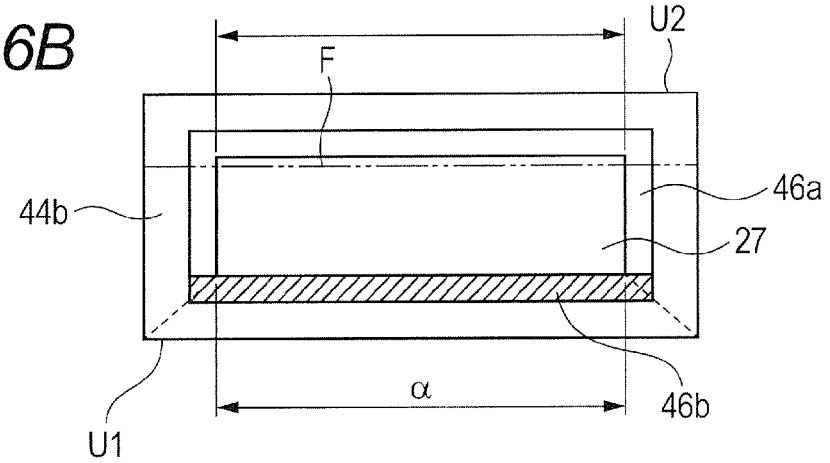
FIG. 16B is an explanatory front view for illustrating a bonded state of a sealing member as viewed from a direction of the arrow X1 of FIG. 16A.
Figure 16C:
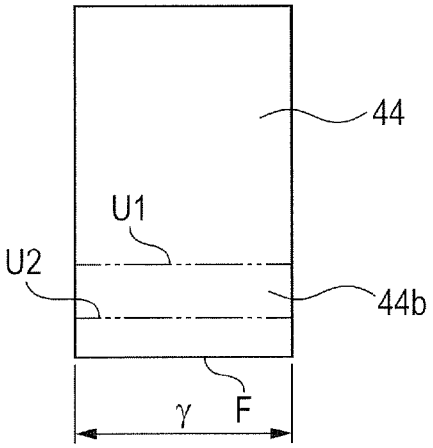
FIG. 16C is an explanatory plan view for illustrating the sealing member according to the seventh embodiment.

With reference to FIG. 16A to FIG. 16C, description is made of an image forming apparatus including a developer container, a developing device, and a process cartridge, which are removably mounted, according to a seventh embodiment of the present invention. The same components as those of the above-mentioned embodiments are denoted by the same reference symbols. Alternatively, the same terms are used even when the components are denoted by different reference symbols, and description thereof is omitted. FIG. 16A is an explanatory sectional view for illustrating the developing device including the developer container according to the seventh embodiment of the present invention. FIG. 16B is an explanatory front view for illustrating a bonded state of a sealing member as viewed from a direction of the arrow X1 of FIG. 16A. FIG. 16C is an explanatory plan view for illustrating the sealing member according to the seventh embodiment.

As illustrated in FIG. 15B, in the sixth embodiment, after remanufacture of the process cartridge B, bonding strength for bonding the sealing portion 44*b* of the sealing member 44 to the peripheral edge portion of the opening 27 is uniform. In this embodiment, as illustrated in FIG. 16B, bonding strength at a bonding region 46*b* is set to be lower than bonding strength at another bonding region 46*a*. The bonding region 46*b* requires shear-peeling of the portion of the sealing portion 44*b* of the sealing member 44 peelably bonded to the peripheral edge of the lower side of the opening 27.

Thus, respective bonding strength of the bonding regions for the sealing portion 44*b* of the sealing member 44 differ in a direction (up-and-down direction of FIG. 16A) of pulling the sealing member 44 along with moving operation (rotating operation in this embodiment) of the stirring unit 2 in a direction of the arrow C of FIG. 16A. The bonding regions for the sealing portion 44*b* of the sealing member 44 are as follows. The sealing member 44 is peeled along with moving operation (rotating operation in this embodiment) of the stirring unit 2 in the direction of the arrow C of FIG. 16A. The bonding strength at the bonding region 46*b* to be shear-peeled is set to be lower than bonding strength at a bonding region that is not shear-peeled (part of the bonding region 46*a* at the peripheral edge of the upper side of the opening 27) when the sealing member 44 is peeled.

The region, which needs to be shear-peeled along the outer peripheral edge of the opening 27 when peeling the bonded portion of the sealing portion 44*b* of the sealing member 44, requires the motor 16 to output the maximum torque for driving the rotating member 45 to rotate at the time of peeling the region. The necessary output of the motor 16 is determined in accordance with the maximum torque at this time. Adhesive strength is originally high in the bonding region 46*b* to be shear-peeled. Accordingly, even when the bonding strength at the bonding region 46*b* to be shear-peeled is set to be lower than the bonding strength at the bonding region 46*a* that is not shear-peeled, sealability of the toner T at the opening 27 is prevented from being degraded. In this embodiment, the sealing member 44 is bonded to the bonding region 46*b* to be shear-peeled, which is hatched in FIG. 16B, with a double-sided adhesive tape. Further, the bonding strength at the bonding region 46*b* is lower than the bonding strength at the another bonding region 46*a* to which the sealing member 44 is bonded by thermal welding.

Also in this embodiment, assuming that the opening 27 illustrated in FIG. 16A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, the following configuration is obtained as compared to the sixth embodiment illustrated in FIG. 15B. As illustrated in FIG. 16B, the bonding strength at the bonding region 46*b* to be shear-peeled, in which the sealing portion 44*b* of the sealing member 44 is peelably bonded to the peripheral edge of the lower side of the opening 27, is set to be lower than the bonding strength at the another bonding region 46*a*. With this configuration, the torque of the motor 16 for driving the rotating member 45 to rotate at the time of peeling the bonding region 46*b* is reduced.

The used sealing member 44 is reused, thereby being capable of achieving remanufacture of the process cartridge B at low cost. Further, during remanufacture of the process cartridge B, the sealing portion 44*b* of the sealing member 44 can be bonded to the peripheral edge portion of the opening 27 from the outer side of the opening 27 of the developer container 29. This embodiment is not limited to remanufacture of the process cartridge B, but is also applicable to production of the new process cartridge B. The other components are the same as those of the above-mentioned embodiments, and the same effects can be obtained.

Eighth Embodiment

Figure 17A:
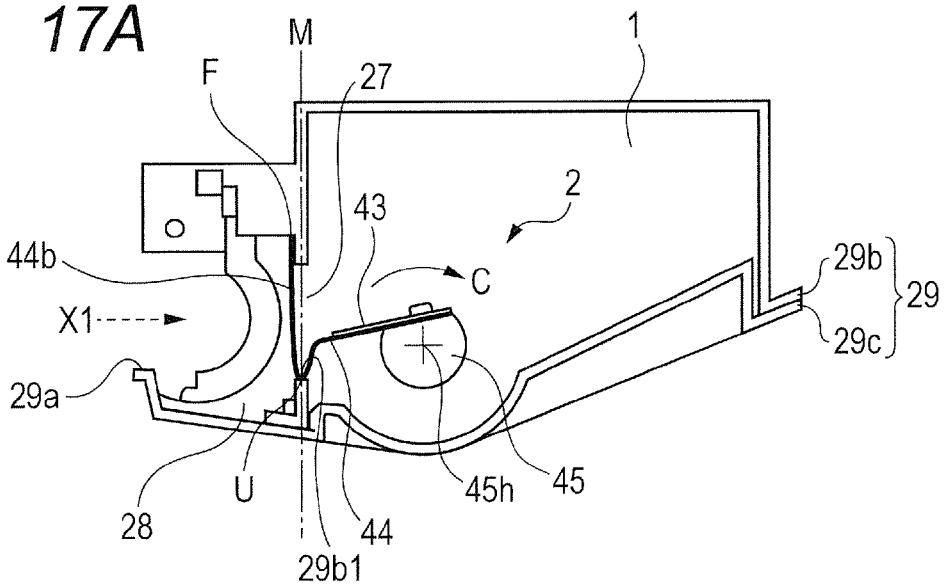
FIG. 17A is an explanatory sectional view for illustrating a developing device including a developer container according to an eighth embodiment of the present invention.
Figure 17B:
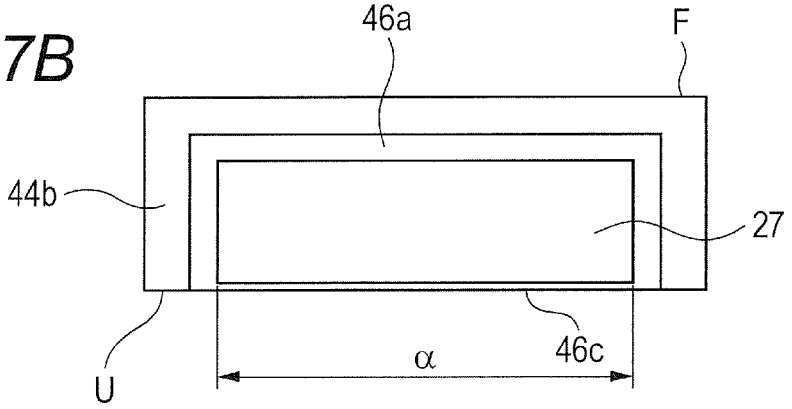
FIG. 17B is an explanatory front view for illustrating a bonded state of a sealing member as viewed from a direction of the arrow X1 of FIG. 17A.
Figure 17C:
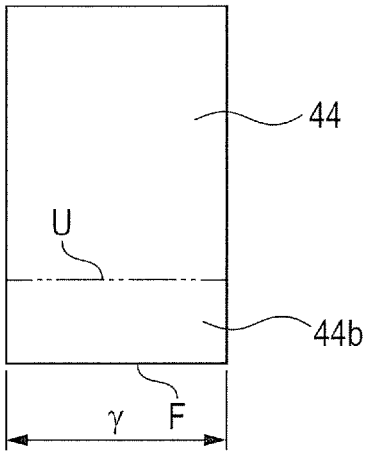
FIG. 17C is an explanatory plan view for illustrating the sealing member according to the eighth embodiment.

Next, with reference to FIG. 17A to FIG. 17C, description is made of an image forming apparatus including a developer container, a developing device, and a process cartridge, which are removbably mounted, according to an eighth embodiment of the present invention. The same components as those of the above-mentioned embodiments are denoted by the same reference symbols. Alternatively, the same terms are used even when the components are denoted by different reference symbols, and description thereof is omitted. FIG. 17A is an explanatory sectional view for illustrating the developing device including the developer container according to the eighth embodiment of the present invention. FIG. 17B is an explanatory front view for illustrating a bonded state of a sealing member as viewed from a direction of the arrow X1 of FIG. 17A. FIG. 17C is an explanatory plan view for illustrating the sealing member according to the eighth embodiment.

In the first embodiment illustrated in FIG. 10A, during remanufacture of the process cartridge B, a position of peelably bonding the sealing portion 44*b* of the sealing member 44 is set to the peripheral edge of the lower side of the opening 27 on the developing chamber 28 side of the developer container 29. In this embodiment, a part of the sealing portion 44*b* of the sealing member 44 is peelably bonded to a wall surface 29*b*1 (rib top) defining the opening 27. With this configuration, as illustrated in FIG. 17B, a bonding width of a bonding region 46*c* of the wall surface 29*b*1 (rib top) defining the opening 27 can be smaller than a bonding width of the another bonding region 46*a*.

Also in this embodiment, assuming that the opening 27 illustrated in FIG. 17A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

In this embodiment, the following configuration is obtained as compared to the first embodiment illustrated in FIG. 10B. As illustrated in FIG. 17B, bonding strength at the bonding region 46*c* of the wall surface 29*b*1 (rib top) defining the lower side of the opening 27 can be set to be lower than the bonding strength at the another bonding region 46*a*. With this configuration, the torque of the motor 16 for driving the rotating member 45 to rotate at the time of peeling the bonding region 46*c* is reduced.

The used sealing member 44 is reused, thereby being capable of achieving remanufacture of the process cartridge B at low cost. Further, during remanufacture of the process cartridge B, the sealing portion 44*b* of the sealing member 44 can be bonded to the peripheral edge portion of the opening 27 from the outer side of the opening 27 of the developer container 29. This embodiment is not limited to remanufacture of the process cartridge B, but is also applicable to production of the new process cartridge B. The other components are the same as those of the above-mentioned embodiments, and the same effects can be obtained.

Ninth Embodiment

Figure 18A:
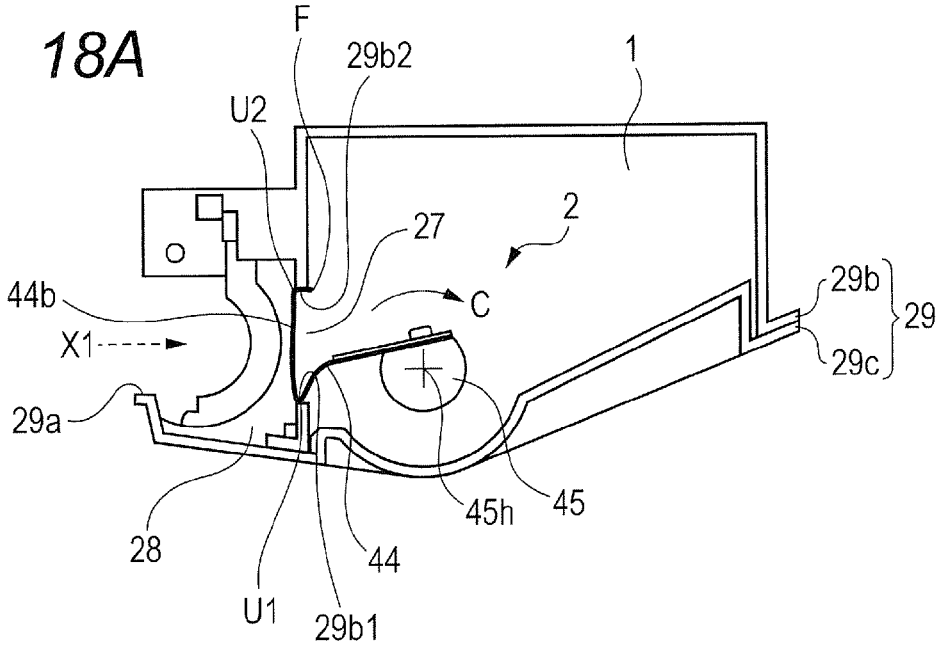
FIG. 18A is an explanatory sectional view for illustrating a developing device including a developer container according to a ninth embodiment of the present invention.
Figure 18B:
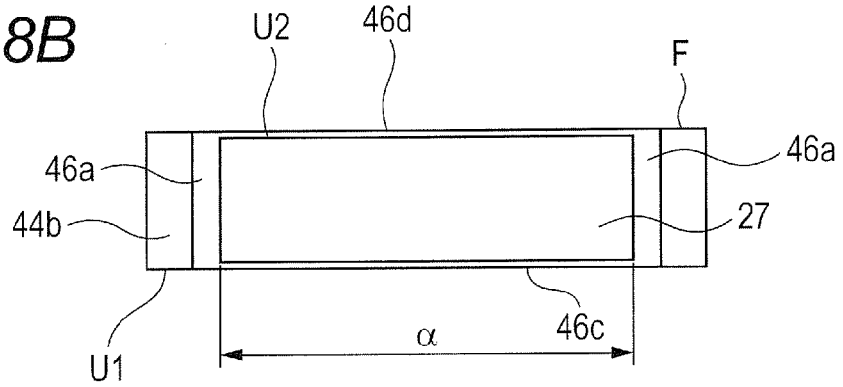
FIG. 18B is an explanatory front view for illustrating a bonded state of a sealing member as viewed from a direction of the arrow X1 of FIG. 18A.
Figure 18C:
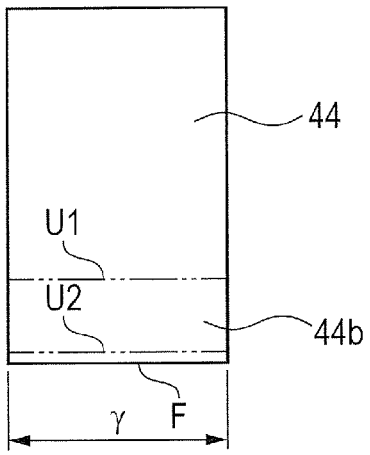
FIG. 18C is an explanatory plan view for illustrating the sealing member according to the ninth embodiment.

With reference to FIG. 18A to FIG. 18C, description is made of an image forming apparatus including a developer container, a developing device, and a process cartridge, which are removably mounted, according to a ninth embodiment of the present invention. The same components as those of the above-mentioned embodiments are denoted by the same reference symbols. Alternatively, the same terms are used even when the components are denoted by different reference symbols, and description thereof is omitted. FIG. 18A is an explanatory sectional view for illustrating the developing device including the developer container according to the ninth embodiment of the present invention. FIG. 18B is an explanatory front view for illustrating a bonded state of a sealing member as viewed from a direction of the arrow X1 of FIG. 18A. FIG. 18C is an explanatory plan view for illustrating the sealing member according to the ninth embodiment.

In the eighth embodiment, as illustrated in FIG. 17A, the position of peelably bonding the sealing portion 44*b* of the sealing member 44 to the peripheral edge of the upper side of the opening 27 is set to the peripheral edge of the upper side of the opening 27 on the developing chamber 28 side of the developer container 29. The position of peelably bonding the sealing portion 44*b* of the sealing member 44 to the peripheral edge of the lower side of the opening 27 is set to the wall surface 29*b*1 (rib top) defining the lower side of the opening 27.

In this embodiment, as illustrated in FIG. 18A, positions of peelably bonding the sealing portion 44*b* of the sealing member 44 to the peripheral edges of the upper and lower sides of the opening 27 are set to wall surfaces 29*b*1 and 29*b*2 (rib tops) respectively defining the upper and lower sides of the opening 27. Thus, as illustrated in FIG. 18B, bonding widths of bonding regions 46*c* and 46*d* of the wall surfaces 29*b*1 and 29*b*2 defining the opening 27 can be smaller than the bonding width of the another bonding region 46*a* formed in peripheral edges of right and left sides of the opening 27.

In this embodiment, the following configuration is obtained as compared to the first embodiment illustrated in FIG. 10B. As illustrated in FIG. 18B, bonding strength at the bonding regions 46*c* and 46*d* of the wall surfaces 29*b*1 and 29*b*2 defining the upper and lower sides of the opening 27 can be set to be lower than the bonding strength at the another bonding region 46*a*. In addition, the folded portion U2 of the sealing member 44 is formed immediately in front of the bonding region 46*d* of the wall surface 29*b*2 (rib top) defining the upper side of the opening 27.

In this embodiment, the following configuration is obtained as compared to the eighth embodiment illustrated in FIG. 17A. The bonding region 46 to be shear-peeled is reduced, thereby reducing the torque of the motor 16 for driving the rotating member 45 to rotate at the time of peeling the bonding regions 46*c* and 46*d*. Further, the used sealing member 44 is reused, thereby being capable of achieving remanufacture of the process cartridge B at low cost. During remanufacture of the process cartridge B, the sealing portion 44*b* of the sealing member 44 can be bonded to the peripheral edge portion of the opening 27 from the outer side of the opening 27 of the developer container 29. This embodiment is not limited to remanufacture of the process cartridge B, but is also applicable to production of the new process cartridge B. The other components are the same as those of the above-mentioned embodiments, and the same effects can be obtained.

Tenth Embodiment

Figure 19A:
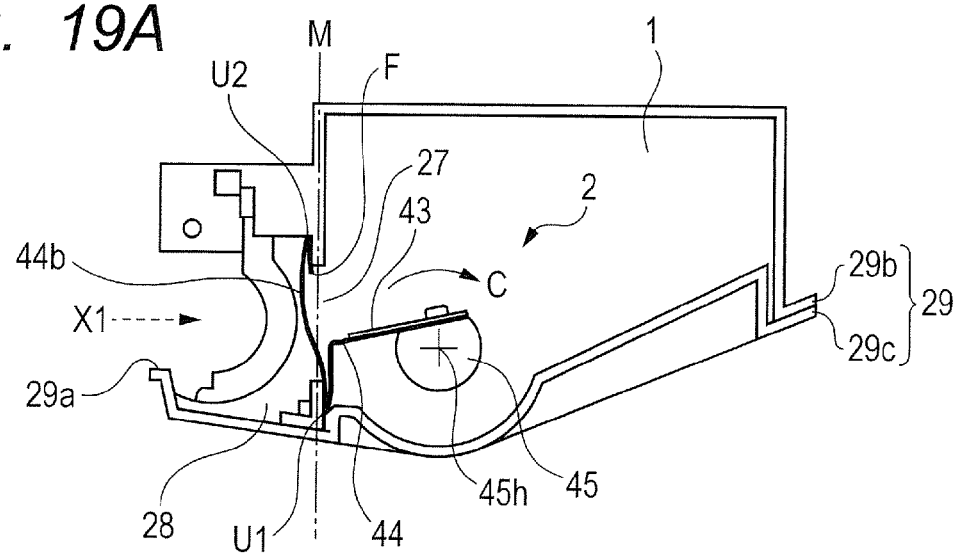
FIG. 19A is an explanatory sectional view for illustrating a developing device including a developer container according to a tenth embodiment of the present invention.
Figure 19B:
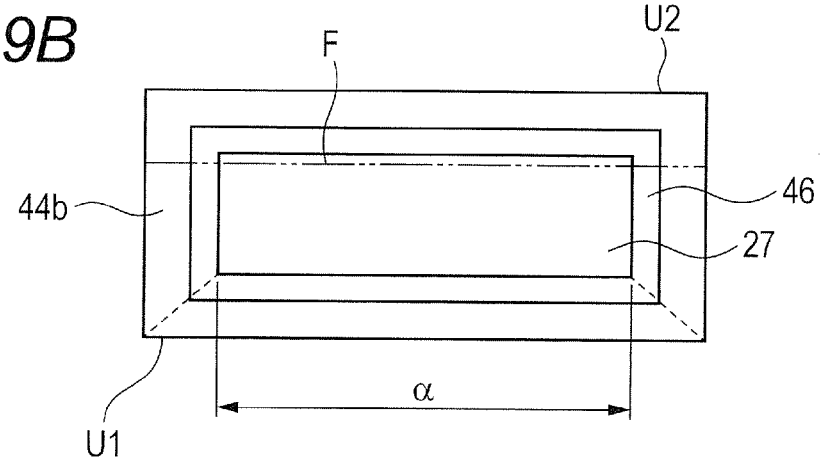
FIG. 19B is an explanatory front view for illustrating a bonded state of a sealing member as viewed from a direction of the arrow X1 of FIG. 19A.
Figure 19C:
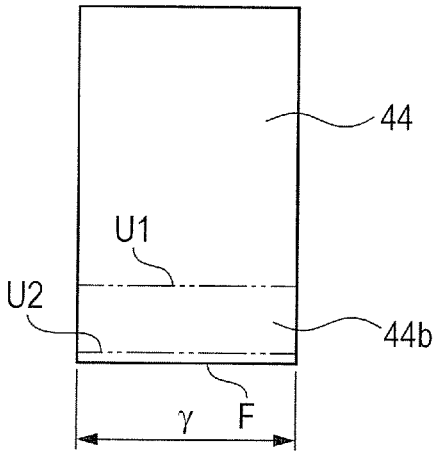
FIG. 19C is an explanatory plan view for illustrating the sealing member according to the tenth embodiment.

With reference to FIG. 19A to FIG. 19C, description is made of an image forming apparatus including a developer container, a developing device, and a process cartridge, which are removably mounted, according to a tenth embodiment of the present invention. The same components as those of the above-mentioned embodiments are denoted by the same reference symbols. Alternatively, the same terms are used even when the components are denoted by different reference symbols, and description thereof is omitted. FIG. 19A is an explanatory sectional view for illustrating the developing device including the developer container according to the tenth embodiment of the present invention. FIG. 19B is an explanatory front view for illustrating a bonded state of a sealing member as viewed from a direction of the arrow X1 of FIG. 19A. FIG. 19C is an explanatory plan view for illustrating the sealing member according to the tenth embodiment.

In the seventh embodiment, as illustrated in FIG. 16A, the position of bonding the sealing portion 44*b* of the sealing member 44 during remanufacture is set to the peripheral edge portion of the opening 27 formed in the container body 29*b* of the developer container 29 on the developing chamber 28 side (outer side).

In this embodiment, as illustrated in FIG. 19A, in the upper side of the opening 27, the position of bonding the sealing portion 44*b* of the sealing member 44 during remanufacture is set to the peripheral edge of the opening 27 on the developing chamber 28 side (outer side). In the lower side of the opening 27, the position of bonding the sealing portion 44*b* of the sealing member 44 during remanufacture is set to the peripheral edge of the opening 27 on the stirring chamber 1 side (inner side).

Also in this embodiment, assuming that the opening 27 illustrated in FIG. 19A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

This configuration sacrifices easiness of assembly of the developer container 29 during remanufacture. However, there can be reduced the bonding region 46 to be shear-peeled, in which the sealing portion 44*b* of the sealing member 44 is bonded not only to the upper peripheral edge of the opening 27 but also to the lower peripheral edge of the opening 27. Accordingly, the torque of the motor 16 for driving the rotating member 45 to rotate at the time of peeling the bonding region 46 can be reduced.

The used sealing member 44 is reused, thereby being capable of achieving remanufacture of the process cartridge B at low cost. During remanufacture of the process cartridge B, the sealing portion 44*b* of the sealing member 44 can be bonded to the upper peripheral edge portion of the opening 27 from the outer side of the upper peripheral edge of the opening 27 of the developer container 29. This embodiment is not limited to remanufacture of the process cartridge B, but is also applicable to production of the new process cartridge B. The other components are the same as those of the above-mentioned embodiments, and the same effects can be obtained.

Eleventh Embodiment

Figure 20A:
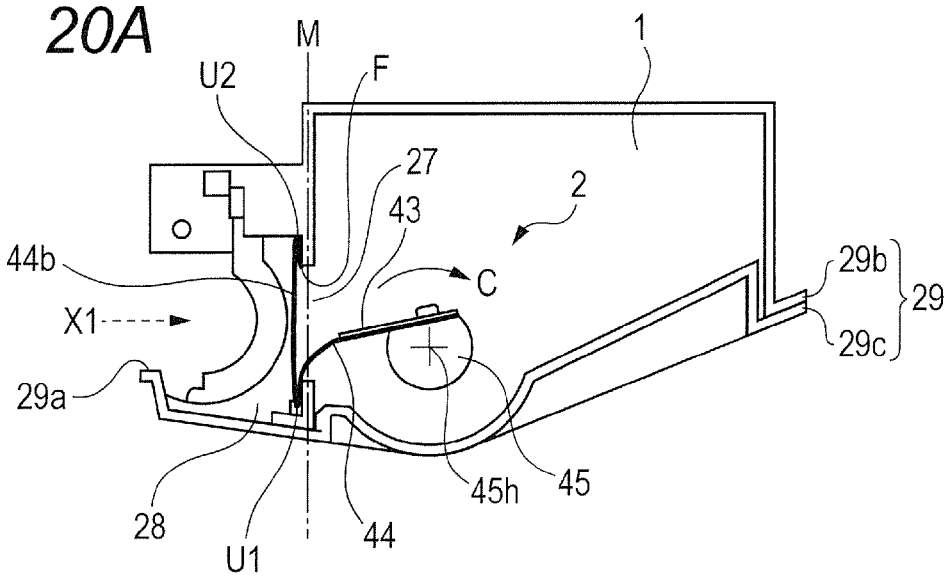
FIG. 20A is an explanatory sectional view for illustrating a developing device including a developer container according to an eleventh embodiment of the present invention.
Figure 20B:
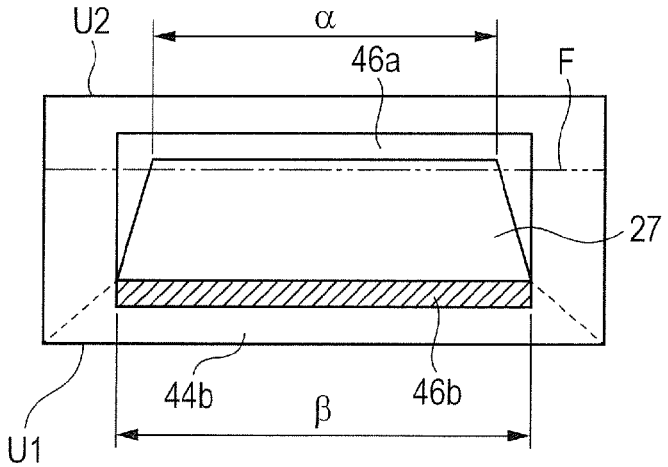
FIG. 20B is an explanatory front view for illustrating a bonded state of a sealing member as viewed from a direction of the arrow X1 of FIG. 20A.
Figure 20C:
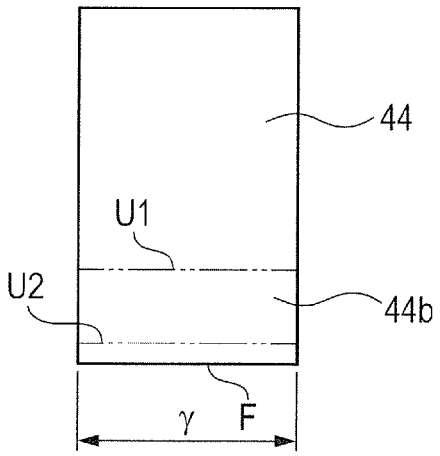
FIG. 20C is an explanatory plan view for illustrating the sealing member according to the eleventh embodiment.

Next, with reference to FIG. 20A to FIG. 20C, description is made of an image forming apparatus including a developer container, a developing device, and a process cartridge, which are removably mounted, according to an eleventh embodiment of the present invention. The same components as those of the above-mentioned embodiments are denoted by the same reference symbols. Alternatively, the same terms are used even when the components are denoted by different reference symbols, and description thereof is omitted. FIG. 20A is an explanatory sectional view for illustrating the developing device including the developer container according to the eleventh embodiment. FIG. 20B is an explanatory front view for illustrating a bonded state of a sealing member as viewed from a direction of the arrow X1 of FIG. 20A. FIG. 20C is an explanatory plan view for illustrating the sealing member according to the eleventh embodiment.

In this embodiment, as illustrated in FIG. 20B, a shape of the opening 27 formed in the container body 29*b* of the developer container 29 is set to a trapezoidal shape. As illustrated in FIG. 20A, at the upper peripheral edge of the opening 27, the sealing portion 44*b* of the sealing member 44 is folded along the folded portion U2, and the free end portion F is peelably bonded. Thus, the bonding region 46*a* in the upper peripheral edge of the opening 27 can be prevented from being shear-peeled. The bonding region 46*b* in the lower peripheral edge of the opening 27 is shear-peeled, but the bonding strength at the bonding region 46*b* is lower than the bonding strength at the bonding region 46*a* in the upper peripheral edge of the opening 27.

Also in this embodiment, assuming that the opening 27 illustrated in FIG. 20A is the boundary M, the sealing portion 44*b* that is a part of the sealing member 44 is peelably bonded to the outer peripheral edges of the opening 27 on the opposite side of the stirring unit 2 including the stirring member 43 serving as the unsealing member. Along with moving operation (rotating operation in this embodiment) of the stirring unit 2, the sealing member 44 is peeled from the outer peripheral edges of the opening 27, thereby unsealing the opening 27.

With this configuration, the torque of the motor 16 for driving the rotating member 45 to rotate at the time of peeling the bonding regions 46*a* and 46*b* can be reduced. Further, the used sealing member 44 is reused, thereby being capable of achieving remanufacture of the process cartridge B at low cost. During remanufacture of the process cartridge B, the sealing portion 44*b* of the sealing member 44 can be bonded to the peripheral edge portion of the opening 27 from the outer side of the opening 27 of the developer container 29. Thus, the process cartridge B can easily be remanufactured. This embodiment is not limited to remanufacture of the process cartridge B, but is also applicable to production of the new process cartridge B. The other components are the same as those of the above-mentioned embodiments, and the same effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-014973, filed Jan. 29, 2016, which is hereby incorporated by reference herein in its entirety.

What is claimed is:

1. A developer container, comprising:

a frame body having a chamber for storing developer, the frame body being provided with an opening for connecting an inside of the chamber and an outside of the chamber;

a sealing member configured to seal the opening; and an unsealing member configured to unseal the opening by moving the sealing member, the unsealing member being accommodated inside the chamber, wherein a part of the sealing member is peelably bonded to the frame body at the outside of the chamber, and the part of the sealing member is bonded to at least a part of a peripheral portion of the opening.

2. The developer container according to claim 1, wherein the sealing member is a flexible sheet-like member, and wherein, under a state in which the sealing member seals the opening, a portion of the sealing member corresponding to the opening has a width equal to or smaller than a width of the opening in a direction orthogonal to a direction of conveying developer by the unsealing member, and another portion of the sealing member has a width larger than the width of the opening.

3. The developer container according to claim 2, wherein a cutout portion is formed in a portion of the sealing member corresponding to the opening.

4. The developer container according to claim 1, wherein the sealing member is a flexible sheet-like member, wherein the opening has a plurality of widths that are different in a direction orthogonal to a direction of conveying developer by the unsealing member, wherein one of the plurality of widths of the opening has a length equal to or larger than a width of the sealing member in the direction orthogonal to the direction of conveying, and wherein widths of the opening other than the one of the plurality of widths has a length smaller than the width of the sealing member.

5. The developer container according to claim 1, wherein, in a bonding region for the sealing member, bonding strength differs in a direction of pulling the sealing member.

6. The developer container according to claim 5, wherein the bonding region for the sealing member includes a bonding region that is not shear-peeled when the sealing member is peeled, and a bonding region to be shear-peeled when the sealing member is peeled and having lower bonding strength than the bonding region that is not shear-peeled.

7. The developer container according to claim 1, wherein the developer container is a remanufactured developer container, and the part of the sealing member is peelably bonded to the peripheral portion of the remanufactured developer container.

8. A developer container, comprising:

a frame body having a chamber for storing developer, the frame body being provided with an opening for connecting an inside of the chamber and an outside of the chamber;

a sealing member configured to seal the opening; and an unsealing member configured to unseal the opening by moving the sealing member, the unsealing member being accommodated inside the chamber, wherein the frame body comprises a surface forming the opening, and the surface is located in an intermediate portion between the inside of the chamber and the outside of the chamber, wherein a part of the sealing member is peelably bonded to the surface.

9. The developer container according to claim 8, wherein the frame body has a first chamber and a second chamber, wherein the unsealing member is accommodated inside the first chamber, and wherein the surface is positioned between the first chamber and the second chamber.

10. The developer container according to claim 8, wherein the sealing member is a flexible sheet-like member, and wherein, under a state in which the sealing member seals the opening, a portion of the sealing member corresponding to the opening has a width equal to or smaller than a width of the opening in a direction orthogonal to a direction of conveying developer by the unsealing member, and another portion of the sealing member has a width larger than the width of the opening.

11. The developer container according to claim 10, wherein a cutout portion is formed in a portion of the sealing member corresponding to the opening.

12. The developer container according to claim 8, wherein the sealing member is a flexible sheet-like member, wherein the opening has a plurality of widths that are different in a direction orthogonal to a direction of conveying developer by the unsealing member, wherein one of the plurality of widths of the opening has a length equal to or larger than a width of the sealing member in the direction orthogonal to the direction of conveying, and wherein widths of the opening other than the one of the plurality of widths has a length smaller than the width of the sealing member.

13. The developer container according to claim 8, wherein, in a bonding region for the sealing member, bonding strength differs in a direction of pulling the sealing member.

14. The developer container according to claim 13, wherein the bonding region for the sealing member includes a bonding region that is not shear-peeled when the sealing member is peeled, and a bonding region to be shear-peeled when the sealing member is peeled and having lower bonding strength than the bonding region that is not shear-peeled.

15. The developer container according to claim 8, wherein the developer container is a remanufactured developer container, and the part of the sealing member is peelably bonded to the surface of the remanufactured developer container.

16. A developing device, comprising:

a developer container having:

a frame body having a chamber for storing developer, the frame body being provided with an opening for connecting an inside of the chamber and an outside of the chamber;

a sealing member configured to seal the opening; and an unsealing member configured to unseal the opening by moving the sealing member; and a developer carrier arranged in the developer container so as to be opposed to an image bearing member, wherein the unsealing member is accommodated inside the chamber; and wherein a part of the sealing member is peelably bonded to the frame body at the outside of the chamber, and the part of the sealing member is bonded to at least a part of a peripheral portion of the opening.

17. A process cartridge, which is to be removably mounted to a main body of an image forming apparatus, the process cartridge comprising:

a developer container having:

a frame body having a chamber for storing developer, the frame body being provided with an opening for connecting an inside of the chamber and an outside of the chamber;

a sealing member configured to seal the opening; and an unsealing member configured to unseal the opening by moving the sealing member; and an image bearing member on which an electrostatic latent image is formed, wherein the unsealing member is accommodated inside the chamber; and wherein a part of the sealing member is peelably bonded to the frame body at the outside of the chamber, and the part of the sealing member is bonded to at least a part of a peripheral portion of the opening.

18. An image forming apparatus configured to form an image on a recording material, the image forming apparatus comprising:

a developer container removably mounted to the image forming apparatus, and having:

a frame body having a chamber for storing developer, the frame body being provided with an opening for connecting an inside of the chamber and an outside of the chamber;

a sealing member configured to seal the opening; and an unsealing member configured to unseal the opening by moving the sealing member, wherein the unsealing member is accommodated inside the chamber; and wherein a part of the sealing member is peelably bonded to the frame body at the outside of the chamber, and the part of the sealing member is bonded to at least a part of a peripheral portion of the opening.

* * * * *